US007750927B2

(12) United States Patent
Ito et al.

(10) Patent No.: US 7,750,927 B2
(45) Date of Patent: Jul. 6, 2010

(54) IMAGE PROCESSING APPARATUS, IMAGE PROCESSING METHOD, AND COMPUTER PROGRAM

(75) Inventors: Atsushi Ito, Tokyo (JP); Seiji Kobayashi, Tokyo (JP); Hideki Oyaizu, Tokyo (JP)

(73) Assignee: Sony Corporation, Tokyo (JP)

( * ) Notice: Subject to any disclaimer, the term of this patent is extended or adjusted under 35 U.S.C. 154(b) by 1000 days.

(21) Appl. No.: 11/459,515

(22) Filed: Jul. 24, 2006

(65) Prior Publication Data

US 2007/0030359 A1 Feb. 8, 2007

(30) Foreign Application Priority Data

Aug. 2, 2005 (JP) ..... 2005-223985

(51) Int. Cl.
*G09G 5/00* (2006.01)

(52) U.S. Cl. ..... 345/688; 345/660; 715/784; 715/788; 340/684

(58) Field of Classification Search ..... 345/605, 345/667–671, 684–688, 698; 715/784, 788
See application file for complete search history.

(56) References Cited

U.S. PATENT DOCUMENTS 5,434,591 A * 7/1995 Goto et al. ..... 345/688
5,659,333 A * 8/1997 Okishima ..... 345/688
5,767,822 A 6/1998 Hiroshi
6,043,802 A * 3/2000 Gormish ..... 345/596
6,072,446 A 6/2000 Tokimoto
6,909,433 B2 * 6/2005 Minami ..... 345/536
7,034,839 B2 * 4/2006 Morishita ..... 345/555
7,454,707 B2 * 11/2008 Matsumoto ..... 715/725
7,542,054 B2 * 6/2009 Wang et al. ..... 345/660
2003/0137525 A1 * 7/2003 Smith ..... 345/671

FOREIGN PATENT DOCUMENTS

JP 08-179717 7/1996
JP 09-311659 12/1997
JP 2000-018856 3/2000

* cited by examiner

*Primary Examiner*—Lun-Yi Lao
*Assistant Examiner*—Gregory J Tryder
(74) *Attorney, Agent, or Firm*—Sonnenschein Nath & Rosenthal LLP

(57) ABSTRACT

An image processing apparatus includes an image input section configured to input still image data; a number-of-pixel converter configured to perform number-of-pixel conversion on the still image data; a display image generator configured to generate a scroll display image as output image data to be output to an image display section on the basis of the image data whose number of pixels has been converted, the image data being generated by the number-of-pixel converter; and a controller configured to control the number-of-pixel conversion process and the display image generation process. The number-of-pixel converter includes a spatial thinning processor for performing a spatial thinning process in accordance with the amount of spatial thinning. The display image generator generates a scroll display image on the basis of a frame image.

19 Claims, 16 Drawing Sheets

FIG. 8

| GUI SET SCROLLING VELOCITY (Vx) | AMOUNT OF SPATIAL THINNING IN X DIRECTION (Dx) |
|---|---|
| (t3 - t4)／4 | 4 |
| (t5 - t6)／4 | 4 |
| (t7 - )／4 | 4 |
| (t1 - t2)／2 | 2 |
| (t2 - t3)／3 | 3 |
| (t4 - t5)／3 | 3 |
| (t6 - t7)／3 | 3 |

IMAGE PROCESSING APPARATUS, IMAGE PROCESSING METHOD, AND COMPUTER PROGRAM

CROSS REFERENCES TO RELATED APPLICATIONS

The present invention contains subject matter related to Japanese Patent Application JP 2005-223985 filed in the Japanese Patent Office on Aug. 2, 2005, the entire contents of which are incorporated herein by reference.

BACKGROUND OF THE INVENTION

1. Field of the Invention

The present invention relates to an image processing apparatus, an image processing method, and a computer program. More particularly, the present invention relates to an image processing apparatus that is capable of displaying a high-resolution image with high quality when still images are to be displayed on a display device and that realizes high-resolution display by scroll-displaying the still images, to an image processing method for use with the image processing apparatus, and to a computer program for use with the image processing method.

2. Description of the Related Art

Many recent digital cameras having imaging devices (CCDs) have a configuration with a number of pixels exceeding several millions and capable of capturing high-quality image data. However, the current situation is that there are few display devices that support such a number of pixels in order to display such a captured image, and the displayed image do not reproduce high-quality data possessed by the captured.

Several technologies have been proposed for a method for realizing high-resolution display exceeding the limited number of pixels possessed by a display device. For example, in Japanese Unexamined Patent Application Publication Nos. 1996-179717, 1997-311659, and 2000-81856, a method has been proposed in which a display section is structured by arranging a large number of light-emitting device arrays having a large number of light-emitting devices disposed in a straight line at fixed intervals, and by supplying data of each column of display data to the display section while performing timing control, scroll display using an afterimage effect is performed.

SUMMARY OF THE INVENTION

The above-described related art, that is, the configuration in which, by using an afterimage effect, scroll display is performed on a display section having a large number of light-emitting devices arranged at fixed intervals, shows only a configuration that is intended to be capable of enabling viewing of a detailed image produced by a small number of light-emitting devices for the purpose of reducing cost, more specifically, visibility is improved by means of LED light-emission control in an electric light display employing an LED. It, however, does not realize the above-described high-resolution display when a high-resolution image captured by a digital camera or the like is to be displayed on a liquid-crystal display device whose resolution level is not very high.

It is desirable to allow input of image data captured by a high-resolution imaging device and to display an image that can be observed as a high-resolution image even when a low-resolution display device is used. It is also desirable to provide an image processing apparatus that realizes image display at a resolution level higher than the resolution possessed by a display device being used, an image processing method, and a computer program.

According to an embodiment of the present invention, there is provided an image processing apparatus including: an image input section configured to input still image data; a number-of-pixel converter configured to perform number-of-pixel conversion on the still image data; a display image generator configured to generate a scroll display image as output image data to be output to an image display section on the basis of the image data whose number of pixels has been converted, the image data being generated by the number-of-pixel converter; and a controller configured to control number-of-pixel conversion and display image generation, wherein the number-of-pixel converter includes a spatial thinning processor for performing, on each of a plurality of frame images forming the scroll display image, a spatial thinning process in accordance with the amount of spatial thinning with which a super-resolution effect is obtained, the amount of spatial thinning being determined on the basis of a scrolling velocity, and wherein the display image generator generates a scroll display image on the basis of a frame image on which the spatial thinning process has been performed for each frame.

In the embodiment of the image processing apparatus of the present invention, the controller may perform a process for determining the amount of thinning that satisfies conditions under which the super-resolution effect is obtained on the basis of the scrolling velocity of a scroll image to be displayed on the image display section, and the spatial thinning processor may perform a spatial thinning process in accordance with the amount of spatial thinning determined by the controller.

In the embodiment of the image processing apparatus of the present invention, the controller may perform a process for determining the amount of spatial thinning on the basis of a table in which the scrolling velocity of the scroll display image to be displayed on the image display section and the amount of spatial thinning that satisfies conditions under which the super-resolution effect is obtained correspond to each other, and the spatial thinning processor may perform a spatial thinning process in accordance with the amount of spatial thinning determined by the controller.

In the embodiment of the image processing apparatus of the present invention, the controller may perform a process for sequentially verifying, on the basis of a predetermined maximum value, whether or not the scrolling velocity of the scroll display image to be displayed on the image display section falls within a velocity range corresponding to the amount of spatial thinning that satisfies conditions under which the super-resolution effect is obtained, and for determining a largest value of spatial thinning as an amount of thinning in the spatial thinning processor, and the spatial thinning processor may perform a spatial thinning process in accordance with the amount of spatial thinning determined by the controller.

In the embodiment of the image processing apparatus of the present invention, the number-of-pixel converter may include a spatial filtering processor and a spatial thinning processor.

The still image to be input to the image input section may be an input image having a number of pixels m×n, and the scroll display image to be output to the image display section may be an output image having a number of pixels p×q. When the amount of spatial thinning with which the super-resolution effect is obtained is set as an amount of thinning Dx in the X direction and as an amount of thinning Dy in the Y direction, the spatial filtering processor may perform a process for converting an input image having a number of pixels m×n to be input to the image input section into an image having a number of pixels Dxp×Dyq, and on the basis of the image having the number of pixels Dxp×Dyq, which is generated by the spatial filtering processor, the spatial thinning processor may perform a spatial thinning process in which the amount of thinning in the X direction is Dx and the amount of thinning in the Y direction is Dy and may generate an output image having a number of pixels p×q.

The image processing apparatus according to an embodiment of the present invention may further include a memory for storing images processed by the spatial filtering processor, wherein, on the basis of the image having a number of pixels Dxp×Dyq, which is obtained from the memory, the spatial thinning processor may perform a spatial thinning process for each frame and may generate an output image having a number of pixels p×q.

The image processing apparatus according to an embodiment of the present invention may further include a parameter input section configured to input a parameter of the scrolling velocity, wherein the controller determines the amount of thinning to be performed in the spatial thinning processor on the basis of the scrolling velocity input from the parameter input section.

In the embodiment of the image processing apparatus of the present invention, the controller may include a parameter computation section configured to determine a parameter of the scrolling velocity, and the parameter computation section may perform a process for inputting a number of pixels of a still image to be input to the image input section, for computing the values of the number of pixels of the scroll display image and the scrolling velocity of the scroll image, which satisfy conditions under which the super-resolution effect is obtained, and for determining the amount of thinning to be performed in the spatial thinning processor in accordance with the computed number of pixels and the computed scrolling velocity.

In the embodiment of the image processing apparatus of the present invention, on the basis of a frame image on which a spatial thinning process has been performed for each frame, the display image generator may perform a rendering process in units of frames, in which frame movement based on the scrolling velocity is considered.

The image processing apparatus according to the embodiment of the present invention may further include an image display section configured to display a scroll display image generated by the display image generator.

According to another embodiment of the present invention, there is provided an image processing method including the steps of: inputting still image data; determining an image processing parameter; performing number-of-pixel conversion on the still image data on the basis of the parameter; and generating a scroll display image as output image data to be output to an image display section on the basis of the image data whose number of pixels has been converted, the image data being generated in the number-of-pixel conversion, wherein the number-of-pixel conversion includes the step of performing, on each of a plurality of frame images forming the scroll display image, a spatial thinning process in accordance with the amount of spatial thinning with which a super-resolution effect is obtained, the amount of spatial thinning being determined on the basis of a scrolling velocity, and wherein, in the display image generation, a process for generating a scroll display image on the basis of a frame image on which the spatial thinning process has been performed for each frame is performed.

In the embodiment of the image processing method of the present invention, in the parameter determination, a process for determining the amount of spatial thinning that satisfies conditions under which the super-resolution effect is obtained on the basis of the scrolling velocity of the scroll display image to be displayed on the image display section may be performed, and in the spatial thinning, a spatial thinning process in accordance with the amount of spatial thinning determined in the parameter determination may be performed.

In the embodiment of the image processing method of the present invention, in the parameter determination, a process for determining the amount of spatial thinning on the basis of a table in which the scrolling velocity of the scroll display image to be displayed on the image display section and the amount of spatial thinning that satisfies conditions under which the super-resolution effect is obtained correspond to each other may be performed, and in the spatial thinning, a spatial thinning process in accordance with the amount of spatial thinning determined in the parameter determination may be performed.

In the embodiment of the image processing method of the present invention, in the parameter determination, a process may be performed for sequentially verifying, on the basis of a predetermined maximum value, whether or not the scrolling velocity of the scroll display image to be displayed on the image display section falls within a velocity range corresponding to the amount of spatial thinning that satisfies conditions under which the super-resolution effect is obtained, and for determining a largest value of spatial thinning as an amount of thinning in the spatial thinning, and in the spatial thinning, a spatial thinning process in accordance with the amount of spatial thinning determined in the parameter determination may be performed.

In the embodiment of the image processing method of the present invention, the number-of-pixel conversion may include the steps of performing a spatial filtering process and performing a spatial thinning process, the still image to be input in the image input may be an input image having a number of pixels m×n, and the scroll display image to be output to the image display section may be an output image having a number of pixels p×q. When the amount of spatial thinning with which the super-resolution effect is obtained is set as an amount of thinning Dx in the X direction and as an amount of thinning Dy in the Y direction, in the spatial filtering, a process for converting an input image having a number of pixels m×n input in the image input into an image having a number of pixels Dxp×Dyq may be performed, and on the basis of the image having the number of pixels Dxp×Dyq, which is generated in the spatial filtering, in the spatial thinning, a spatial thinning process in which the amount of thinning in the X direction is Dx and the amount of thinning in the Y direction is Dy may be performed, and an output image having a number of pixels p×q may be generated.

The image processing method according to the embodiment of the present invention may further include the step of storing, in a memory, images processed in the spatial filtering, wherein, on the basis of the image having the number of pixels Dxp×Dyq, which is obtained from the memory, in the spatial thinning, a spatial thinning process is performed for each frame, and an output image having a number of pixels p×q is generated.

The image processing method according to the embodiment of the present invention may further include the step of inputting a parameter of the scrolling velocity, wherein, in the parameter determination, a process for determining the amount of thinning to be used in the spatial thinning on the basis of the scrolling velocity input in the parameter input is performed.

In the embodiment of the image processing method of the present invention, in the parameter determination, a process may be performed for inputting the number of pixels of the still image input in the image input, for computing the values of the number of pixels of the scroll display image and the scrolling velocity of the scroll image, which satisfy conditions under which the super-resolution effect is obtained, and for determining the amount of thinning to be performed in the spatial thinning on the basis of the computed number of pixels and the computed scrolling velocity.

In the embodiment of the image processing method of the present invention, on the basis of a frame image on which a spatial thinning process has been performed for each frame, the display image generation may include the step of performing a rendering process in units of frames, in which frame movement based on the scrolling velocity is considered.

The image processing method according to the embodiment of the present invention may further include the step of displaying a scroll display image generated in the display image generation.

According to another embodiment of the present invention, there is provided a computer program for enabling an image processing apparatus to perform a process for generating a scroll display image based on a still image, the computer program including the steps of: inputting still image data; determining an image processing parameter; performing number-of-pixel conversion on the still image data on the basis of the parameter; and generating a scroll display image as output image data to be output to an image display section on the basis of the image data whose number of pixels has been converted, the image data being generated in the number-of-pixel conversion, wherein the number-of-pixel conversion includes the step of performing, on each of a plurality of frame images forming the scroll display image, a spatial thinning process in accordance with the amount of spatial thinning with which a super-resolution effect is obtained, the amount of spatial thinning being determined on the basis of a scrolling velocity, and wherein, in the display image generation, a process for generating a scroll display image on the basis of a frame image on which the spatial thinning process has been performed for each frame is performed.

The computer program according to an embodiment of the present invention is, for example, a computer program that can be provided in a computer-readable format to a general-purpose computer system capable of executing various program codes by means of a storage medium or a communication medium, for example, by means of a storage medium such as a CD, an FD, and an MO or a communication medium such as a network. As a result of providing such a program in a computer-readable format, processing corresponding to the program can be implemented on the computer system.

According to an embodiment of the present invention, when a still image is to be displayed on a display device, display is performed at a predetermined scroll velocity. A spatial thinning process in accordance with the amount of spatial thinning with which a super-resolution effect is obtained, which is determined on the basis of the scrolling velocity, is performed on each of frame images forming the scroll display image, generating frame images and outputting the frame images to a display section. As a consequence, the scroll image displayed on the display device brings about a super-resolution effect by the vision system, and the scroll image is observed for a user (viewer) as a high-resolution image having a number of pixels greater than that of the display section, making it possible to provide a high-quality display image.

Further objects, features and advantages of the present invention will become apparent from the following detailed description of the embodiments of the present invention with reference to the attached drawings. In this specification, the system designates a logical assembly of a plurality of devices. It is not essential that the devices be disposed in the same housing.

BRIEF DESCRIPTION OF THE DRAWINGS

FIG. 8 illustrates an example of a table used to determine the amount of thinning in a spatial thinning process to be performed by the spatial thinning processor;

DESCRIPTION OF THE PREFERRED EMBODIMENTS

Figure 1:
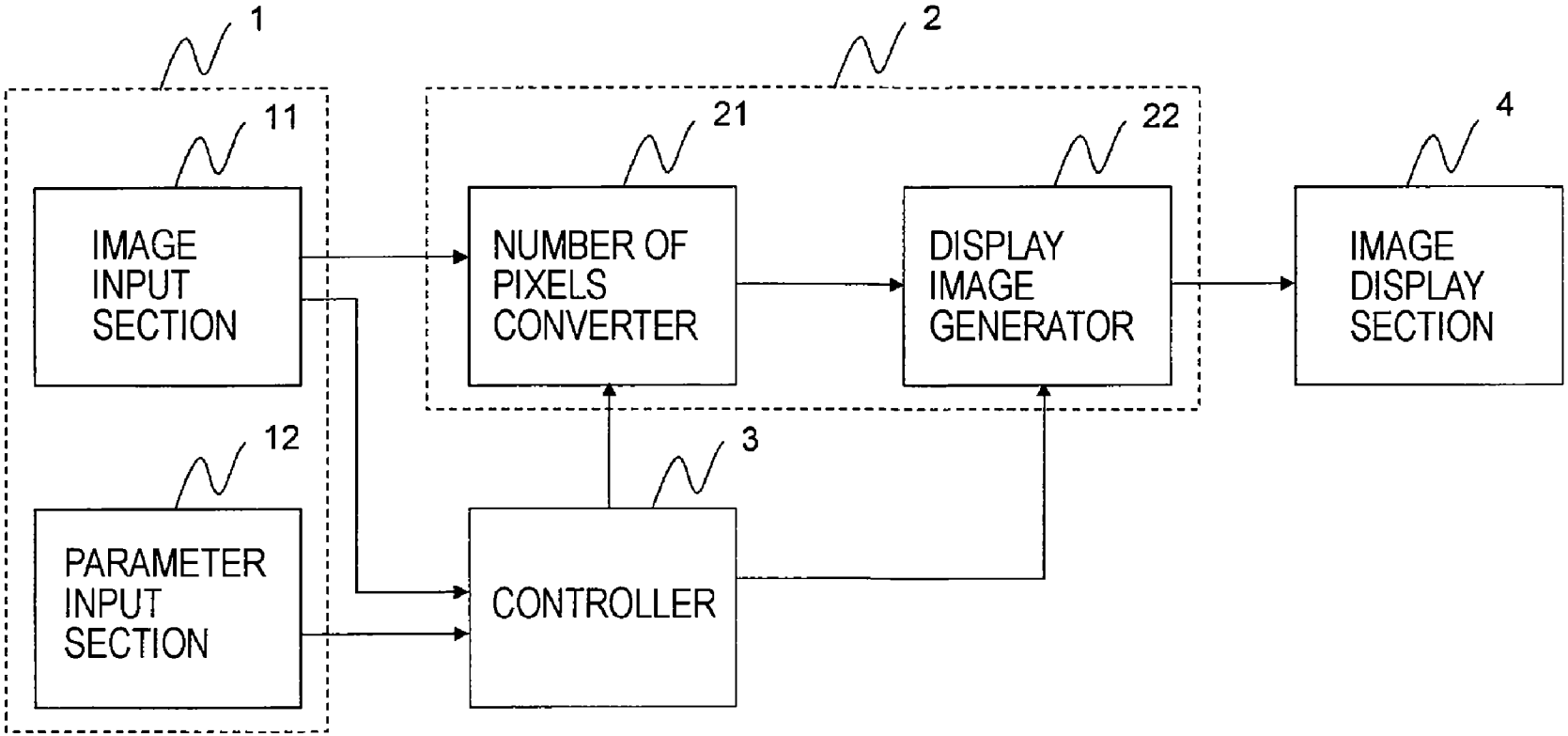
FIG. 1 shows the configuration of an image processing apparatus according to an embodiment of the present invention.

Referring to the drawings, a description will be given below of the configuration of an image processing apparatus, an image processing method, and a computer program according to embodiments of the present invention.

The configuration and processing of the image processing apparatus according to a first embodiment of the present invention will now be described with reference to FIG. 1 and subsequent figures. FIG. 1 is a block diagram showing the configuration of the image processing apparatus according to the first embodiment of the present invention, also showing an image processing apparatus for inputting still image data, for performing image processing on input still image data, and for displaying images on an image display section such as a display device. In the image processing apparatus according to the embodiment of the present invention, a still image input to an image input section 11 is image data at a comparatively high resolution, which is captured by, for example, a digital camera. An image display section 4 for outputting an image is, for example, a display device having a resolution lower than the resolution level of the input image.

The image processing apparatus according to the embodiment of the present invention performs image processing based on a parameter input to a parameter input section 12 on still image data input to the image input section 11 and displays a scroll image of a still image on the image display section 4. This scroll image becomes an image observed as a high-resolution image for a user who views the image.

The configuration of the image processing apparatus shown in FIG. 1 will now be described. The image processing apparatus according to this embodiment includes an interface section 1 for inputting an input still image signal and for inputting a parameter necessary for generating a scroll image to be displayed on the image display section 4; an image converter 2 for performing number-of-pixel conversion and generating an output image on the basis of a parameter; a controller 3 for controlling an image conversion process in the image converter 2; and an image display section 4 for displaying an image signal generated by the image converter 2.

The interface section 1 includes an image input section 11 for inputting an input still image signal and a parameter input section 12 for inputting a parameter necessary for generating a scroll image. As described above, the image input section 11 inputs, for example, a still image signal, such as an image captured by a digital camera.

The still image input to the image input section 11 is converted into a signal in an internal data format defined by the image processing apparatus. Furthermore, as a result of analyzing the input image or analyzing attribute information attached to the input image, the number of pixels forming the still image is obtained. The signal in the internal data format, which is converted by the image input section 11, is output to the image converter 2. The data of the number of pixels of the input still image, which is obtained by the image input section 11, is output to the controller 3.

On the other hand, parameters necessary for generating a scroll image are input to the parameter input section 12 of the interface section 1. Some of these parameters can be set as desired by a user via a user interface (to be described later).

For parameters used for processing, default parameters that are set in advance may be used. When a parameter that is set in advance is to be used, the parameter input section 12 shown in FIG. 1 becomes unnecessary, and the controller 3 obtains necessary parameters from a storage section in which parameters are stored. Alternatively, optimum parameters may be sequentially computed on the basis of the information of the number of pixels of the input still image. In this case, in place of the parameter input section 12 shown in FIG. 1, a parameter computation section is constructed.

Examples of parameters necessary for generating a scroll image include the number of display frames of the scroll image to be displayed on the image display section 4 and the display frame rate thereof, and furthermore includes the number of pixels forming the scroll image and the scrolling velocity thereof. Details of them will be described later.

In this embodiment, an example is described in which set values are used for the number of display frames of the scroll image to be displayed on the image display section 4 and the display frame rate thereof, and the number of pixels of the scroll image to be displayed on the image display section 4 and the scrolling velocity thereof are input from the parameter input section 12. An example of processing in which the parameter input section 12 is not provided, and stored or computed parameters are used will be described later as a second embodiment of the present invention.

A parameter input to the parameter input section 12 is input to the controller 3. A still image signal to be processed, which is output from the image input section 11 in the interface section 1 and which is input to the image converter 2, is first input to a number-of-pixel converter 21 in the image converter 2, whereby a predetermined number-of-pixel conversion process is performed.

The number-of-pixel conversion process in the number-of-pixel converter 21 is performed under the control of the controller 3 on the basis of each piece of the data of the number of pixels of the input still image input from the image input section 11 to the controller 3 and on the basis of the number of pixels of the scroll image and the movement velocity thereof, which are parameters input from the parameter input section 12 to the controller 3.

The image signal on which a number-of-pixel conversion process has been performed by the number-of-pixel converter 21 of the image converter 2 is next input to the display image generator 22 of the image converter 2. In the display image generator 22, a rendering process is performed on the input image signal under the control of the controller 3, and a display image signal formed of pixel data having the same number of pixels possessed by the display device forming the image display section 4 is generated.

The image signal generated by the display image generator 22 is output from the display image generator 22 and is input to the image display section 4, whereby a display process is performed.

The image conversion process to be performed by the number-of-pixel converter 21 and the display image generator 22 needs to be performed for each of the frames of the display image output to the image display section 4. Therefore, the image conversion process is repeatedly performed for the number of times corresponding to the number of frames. The frame in this embodiment indicates an image data unit at which the image display section 4 rewrites the screen, and one frame corresponds to one piece of image data that is output to the image display section 4 as a result of the image conversion process being performed by the display image generator 22.

In the image processing apparatus according to the embodiment of the present invention, a process is performed in which, when an input still image is to be output to the image display section 4, the display position of each frame is sequentially changed, and the input still image is displayed as a scroll image. As a result of this scroll display, a high-resolution image with high quality can be displayed.

The image display section 4 receives an image signal output by the display image generator 22 and displays this signal at a predetermined frame rate. Since the image processing apparatus according to the embodiment of the present invention has features such that the super-resolution effect becomes more noticeable in the image display at a high frame rate, it is preferable that the image display section 4 be formed of a display device capable of performing display at a high frame rate.

Hereinafter, details of processing carried out in each block will be described for each block of the configuration shown in FIG. 1.

The interface section 1, as described above, includes the image input section 11 and the parameter input section 12. First, the image input section 11 receives a still image signal, which is an input for the image processing apparatus. At this time, as described above, the input still image is converted into an internal data format in the image processing apparatus, and the number of pixels forming the input still image is read. It does not particularly matter what input means are used for inputting a still image signal in the image input section 11.

Various data input configurations can be applied, for example, the image input section 11 has a section for receiving a medium, such as a flash memory, and input is made from the medium inserted by the user; or the image input section 11 has an external interface such as a USB, and input is made from the storage medium connected thereto.

A parameter necessary for generating a scroll image is input to the parameter input section 12. In this embodiment, as described above, the number of pixels of the scroll image and the scrolling velocity thereof are input via a user interface. The "scrolling velocity" is a parameter indicating a scrolling velocity (number of pixels/frame) indicating how many pixels the scroll image is moved per frame when an image is displayed by the image display section 4 (to be described later).

The input means in the parameter input section 12 is formed of, for example, a user interface (GUI) set in the image processing apparatus. The interface section has input devices, such as a display device and a mouse. The user of the image processing apparatus inputs parameters for the scroll image by using the input device.

Figure 2:
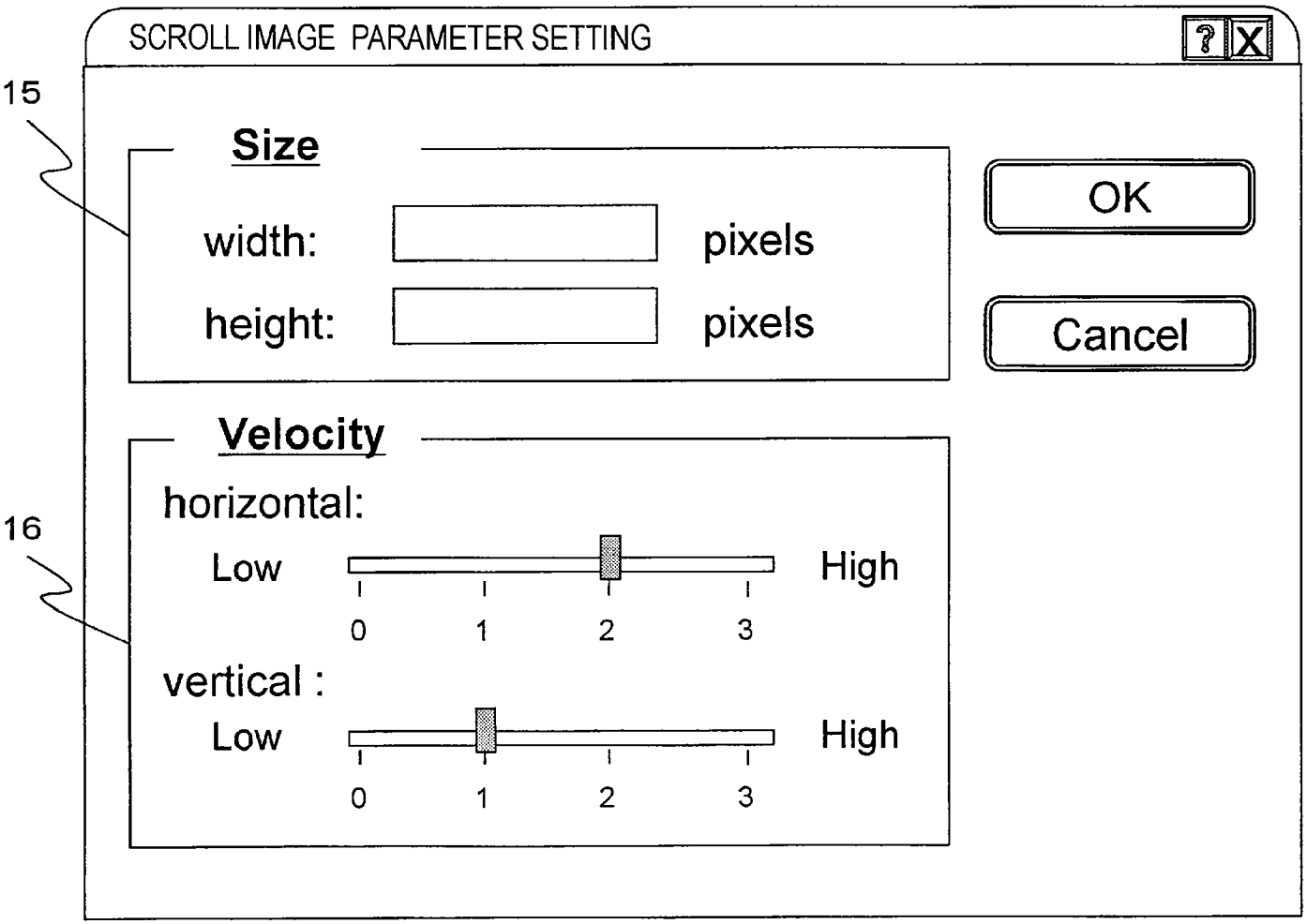
FIG. 2 shows an example of the configuration of a user interface in a parameter input section.

An example of the configuration of the user interface (GUI) via which parameter input is performed is shown in FIG. 2. As shown in FIG. 2, the user interface has a number of pixels of scroll image setting section 15 for setting the number of pixels (pixels) in the horizontal direction (width) and the number of pixels (pixels) in the vertical direction (height) as the numbers of pixels of the scroll image, and a scrolling velocity (Velocity) setting section 16 for setting a movement velocity in the horizontal direction (width) and a movement velocity in the vertical direction (height) as the scrolling velocities of the scroll image. The user inputs the number of pixels of the scroll image and the scrolling velocity thereof as parameters by using these setting sections.

In the example of the user interface shown in FIG. 2, a GUI is designed so that the value of the number of pixels of the scroll image can be input to a text box. It is possible for the user to set the number of pixels of the scroll image by inputting any desired value into the text box. Since the value is the number of pixels of the image, the permissible input value is limited to a positive integer value.

The GUI in the example of FIG. 2 is designed so as to be capable of accepting input using a scroll bar with respect to the movement velocity of the scroll image, which is another parameter. By moving the scroll bar using an input device such as a mouse, it is possible for the user to select one of the scrolling velocities in the x-axis direction (horizontal direction) and one of the scrolling velocities in the y-axis direction (vertical direction) from among those represented by, for example, 4 steps from 0 to 3.

The numerical values of 4 steps from 0 to 3 are numerical symbols indicating the sequence of the relative magnitude with respect to the movement velocity, and does not have a specific meaning in the real world. In other words, this numerical value is a numerical symbol that does not directly represent how many pixels the scroll image is moved per frame and that is assigned with a sequence number according to the magnitude thereof. For this reason, the user specifies the scrolling velocity by using the scroll bar on the GUI. This scrolling velocity needs to be read and internally converted into the unit of "pixels/frame" indicating actually how many pixels the scroll image is moved per frame.

The actual scrolling velocity corresponding to the choice (0, 1, 2, 3) set in the scrolling velocity (Velocity) section 16 of the user interface shown in FIG. 2 may in a linearly increasing manner as in the following for example, 0→0 (pixels/frame),
1→1.5 (pixels/frame),
2→3.0 (pixels/frame), and
3→4.5 (pixels/frame), or may be set in a non-linearly increasing manner as in the following order, for example, 0→0 (pixels/frame),
1→1.6 (pixels/frame),
2→1.9 (pixels/frame), and
3→2.7 (pixels/frame).

In the user interface shown in FIG. 2, the number of choices of the scrolling velocity is set to four, but this may be set to any number. In the GUI shown in FIG. 2, an example in which any desired value can be input with respect to the number of pixels of the scroll-image and the movement velocity thereof is input using a multiple choice is shown. Alternatively, a method of inputting any desired value with respect to both the parameters, or a multiple choice input method, may be used with respect to both the parameters. Furthermore, with respect to a parameter input method, of course, a method other than the method using a GUI as in this embodiment may also be used.

The still image data read by the image input section 11 is converted into an internal data format signal in the manner described above, and thereafter it is input to the image converter 2. The data of the number of pixels read by the image input section 11 is input to the controller 3. On the other hand, the data of the number of pixels of the scroll image and the scrolling velocity thereof, which is input to the parameter input section 12 of the interface section 1, is input to the controller 3.

Figure 3:
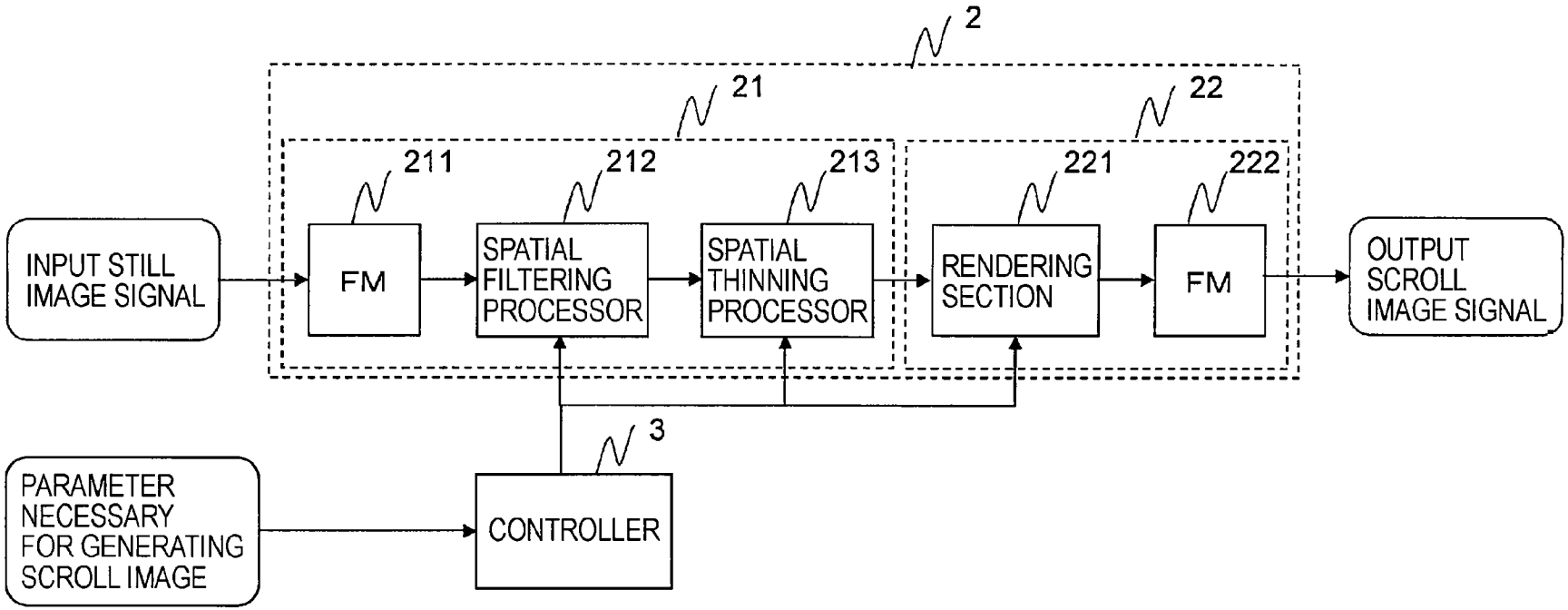
FIG. 3 shows an example of the configuration of an image converter 2 in the image processing apparatus according to the embodiment of the present invention.

Processing to be performed by the image converter 2 will be described below. FIG. 3 shows a detailed configuration of the image converter 2. As described above with reference to FIG. 1, the image converter 2 in this embodiment includes the number-of-pixel converter 21 and the display image generator 22.

The number-of-pixel converter 21 includes a frame memory (FM) 211 for storing input still image signals, a spatial filtering processor 212 for inputting still image data from the frame memory (FM) 211 and for converting the number of pixels into a first number of pixels, and a spatial thinning processor 213 for inputting still image data in which number-of-pixel conversion into the first number of pixels has been performed and for converting the number of pixels into a second number of pixels.

On the other hand, the display image generator 22 includes a rendering section 221 for inputting still image data in which conversion of the number of pixels into the second number of pixels output from the spatial thinning processor 213 has been performed and for generating an output image having a number of pixels that can be displayed by the image display section 4, and a frame memory 222 for storing frames of the output image, which is a frame image generated by the rendering section 221.

The still image signal in the internal data format, which is output from the interface section 1, is first input to the number-of-pixel converter 21 in the image converter 2. It is assumed that the input still image signal in this embodiment has m×n pixels. That is, the input still image signal is a still image having m pixels in the x (horizontal) direction and n pixels in the y (vertical) direction, where m and n are positive integers.

As described above, parameters necessary for generating a scroll image is input to the parameter input section 12 of the interface section 1. In this embodiment, as the parameters to be input to the controller 3:

the number of pixels of the scroll image is denoted as p×q pixels, and the scrolling velocities of the scroll image in the x axis and in the y axis direction are denoted as Vx and Vy (pixels/frame), respectively, and are used for the following description.

p and q are positive integers, and Vx and Vy are real numbers about which it does not matter whether the value is a positive or negative value. In this embodiment, for the x axis, the right direction is defined to be positive, and for the y axis, the downward direction is defined to be positive. The display device forming the image display section 4 is assumed to have i×j pixels. i and j are positive integers.

As a result of a series of image conversion processes in the image converter 2, the image signal that has the specified number of pixels and that scrolls at the specified movement velocity is output as an image signal in the image display section 4 formed of a display device having i×j pixels.

The pixels of the image display section 4, which are outside the area of p×q pixels of the scroll image among the i×j pixels forming the display device, which can be displayed by the image display section 4, are caused not to emit light in the image display section 4. Alternatively, it is preferably set that a uniform background color signal (gray, blue, etc.) be output. This processing will be described later in the description of a rendering process.

As described above, the input still image has m×n pixels, the output scroll image has p×q pixels, and the pixels forming the display device has i×j pixels. As described above, in the image processing apparatus according to the embodiment of the present invention, a high-resolution image display is realized on a low-resolution display device. When the number of pixels of the input still image (m×n pixels) is greater than the number of pixels (i×j pixels) forming the display device, a high-resolution image can be effectively displayed on a low-resolution display device. Therefore, in this embodiment, a description will be given by assuming that the above-described numbers of pixels satisfy the following conditions, that is, m>i>p, and n>j>q.

The still image signal input to the number-of-pixel converter 21 is first stored in the frame memory 211. On the other hand, the value of the number of pixels m×n of the input still image, and the values of the number of pixels p×q of the scroll image and the scrolling velocities Vx and Vy thereof are input to the controller 3.

On the basis of the values of the parameters necessary for generating a scroll image, the controller 3 determines in advance the amount of spatial thinning that satisfies conditions under which a super-resolution effect is obtained for the X direction and the Y direction. Hereinafter, with respect to this amount of spatial thinning, the amount of thinning in the X direction is denoted as Dx, and the amount of thinning in the Y direction is denoted as Dy (Dx and Dy are positive integers).

For example, the "amount of thinning in the X direction Dx=2" means that one pixel is sampled from among two pixels in the X direction so that compression (reduction) of ½ is performed in the X direction. The "amount of thinning in the X direction Dx=3" means that one pixel is sampled from among three pixels in the X direction so that compression (reduction) of ⅓ is performed in the X direction. The "amount of thinning in the Y direction Dy=2" means that one pixel is sampled from among two pixels in the Y direction so that compression (reduction) of ½ is performed in the Y direction. The "amount of thinning in the Y direction Dx=3" means that one pixel is sampled from among three pixels in the Y direction so that compression (reduction) of ⅓ is performed in the Y direction.

On the basis of the amount of thinning determined by the controller 3, the still image signal stored in the frame memory 211 is processed by the spatial filtering processor 212 and the spatial thinning processor 213 and is converted in the procedure described below.

The super-resolution effect is a vision effect that is realized by vision characteristics such that an observer perceives a plurality of images added within a particular time period. The vision of a human being has a function such that light is perceived when the total sum of stimulus of received light reaches a particular threshold value (integrating function with time). This is known as Bloch's law and indicates that a human being adds light received within a fixed time period and perceives the total light. Time added in the integrating function with time varies with vision environment or the like, and there is a report that it varies between approximately 25 ms and 100 ms. Details of Bloch's law are described in, for example, "Vision Information Handbook, The Vision Society of Japan, pp. 219-220". Japanese Patent Application No. 2003-412500 that is filed earlier for patent by the applicant of the present invention discloses a configuration in which a conversion process that brings about a super-resolution effect in a moving image compression process is realized.

Figure 4:
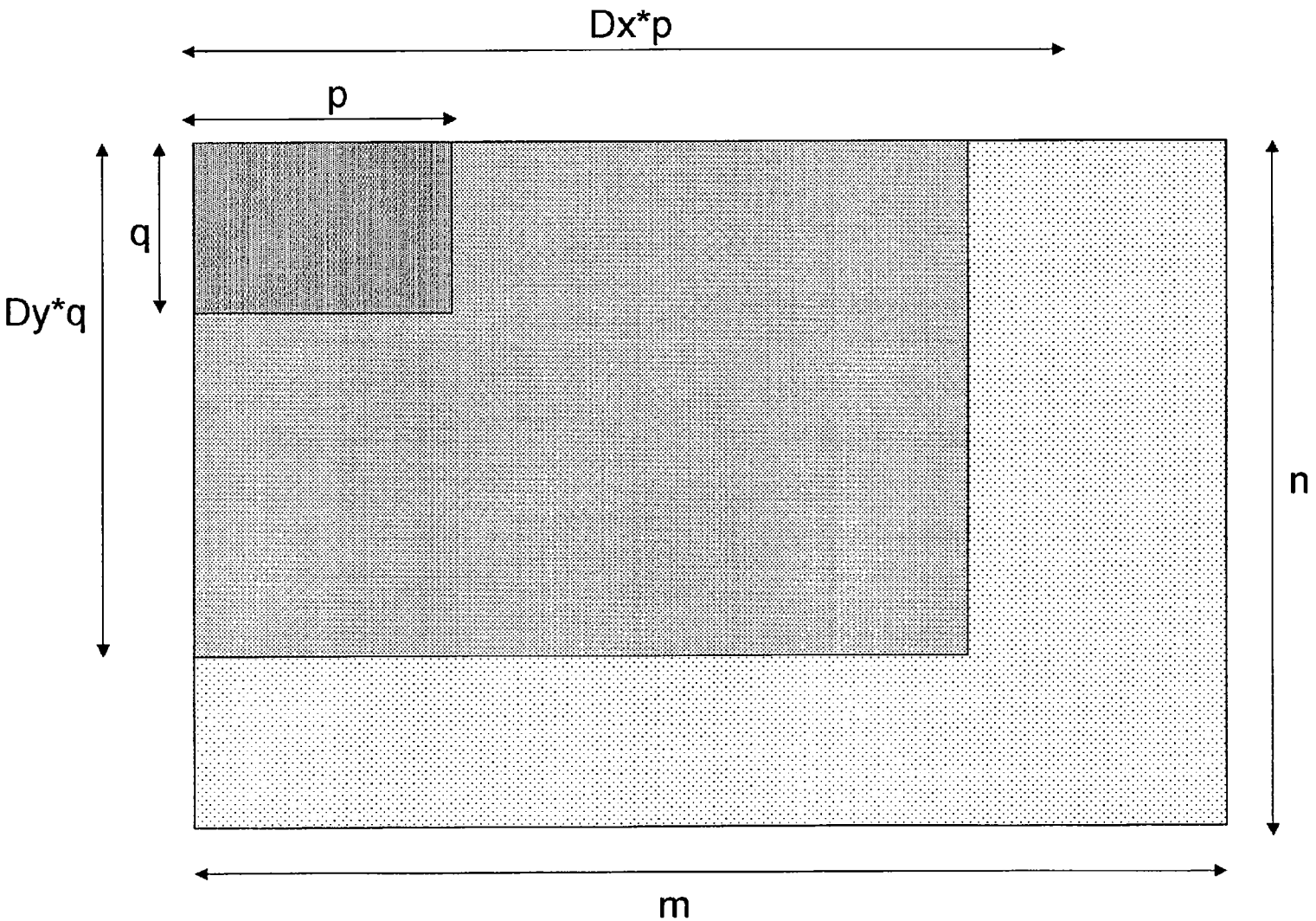
FIG. 4 illustrates a number-of-pixel conversion process to be performed by the image converter.

In the following, the relationship between the spatial filtering process and the spatial thinning process, which are performed by the number-of-pixel converter 21, will be described. FIG. 4 shows the relationship between images having the following pixels:

(a) the number of pixels m×n of an image to be input to the number-of-pixel converter 21, that is, a still image to be processed, (b) the number of pixels Dxp×Dyq of the image after the spatial filtering process in the spatial filtering processor 212, and (c) the number of pixels p×q of the image after the spatial thinning process in the spatial thinning processor 213.

For the image conversion to be performed by the image converter 21, in the spatial filtering processor 212, an input image having a number of pixels m×n is converted into an image of a first number of pixels Dxp×Dyq.

Then, in the spatial thinning processor 213, an image having the first number of pixels Dxp×Dyq is converted into an image of a second number of pixels p×q. As described above, number-of-pixel conversion is performed at two steps.

It is assumed here that the movement velocities Vx and Vy of the scroll image are conditions under which a super-resolution effect can be obtained with the amount of thinning Dx for the X direction and with the amount of thinning Dy for the Y direction.

On the basis of the movement velocities Vx and Vy of the scroll image, which are input from the parameter input section 12, the amounts of spatial thinning Dx and Dy for obtaining a super-resolution effect are computed by the controller 3.

The first number of pixels information [Dxp×Dyq] computed on the basis of the amounts of spatial thinning Dx and Dy and the second number of pixels p×q that is generated finally is input to the spatial filtering processor 212.

As shown in FIG. 4, when the number of pixels m×n of the input image is greater than the number of pixels Dxp×Dyq, the spatial filtering processor 212 performs number-of-pixel conversion by a spatial filtering process before the spatial thinning process is performed by the spatial thinning processor 213, and converts the input still image having the number of pixels m×n into an input still image of the first number of pixels Dxp×Dyq.

The amounts of spatial thinning Dx and Dy for obtaining a super-resolution effect are values that can be computed on the basis of movement velocities Vx and Vy of the image. These are values computed on the basis of Bloch's law described above, the details of which are described in, for example, "Vision Information Handbook, The Vision Society of Japan, pp. 219-220" or are described in Japanese Patent Application No. 2003-412500 described above. The relationship between the movement velocities Vx and Vy of the image and the amounts of spatial thinning Dx and Dy for obtaining a super-resolution effect will be described later.

The spatial filtering processor 212 is a digital filter for limiting the band of the space frequency. On the basis of a desired number of pixels Dxp×Dyq supplied from the controller 3 after foldback components are reduced, the spatial filtering processor 212 converts the input image having the number of pixels m×n into an input image of the first number of pixels Dxp×Dyq.

The spatial thinning processor 213 converts the image data having the first number of pixels Dxp×Dyq, which is output from the spatial filtering processor 212, into an image of a second number of pixels p×q. For the number-of-pixel conversion herein, the space frequency band is not limited, and thinned sampling of the pixels forming the input image is performed. Therefore, the output image of the spatial thinning processor contains foldback components.

Figure 5:
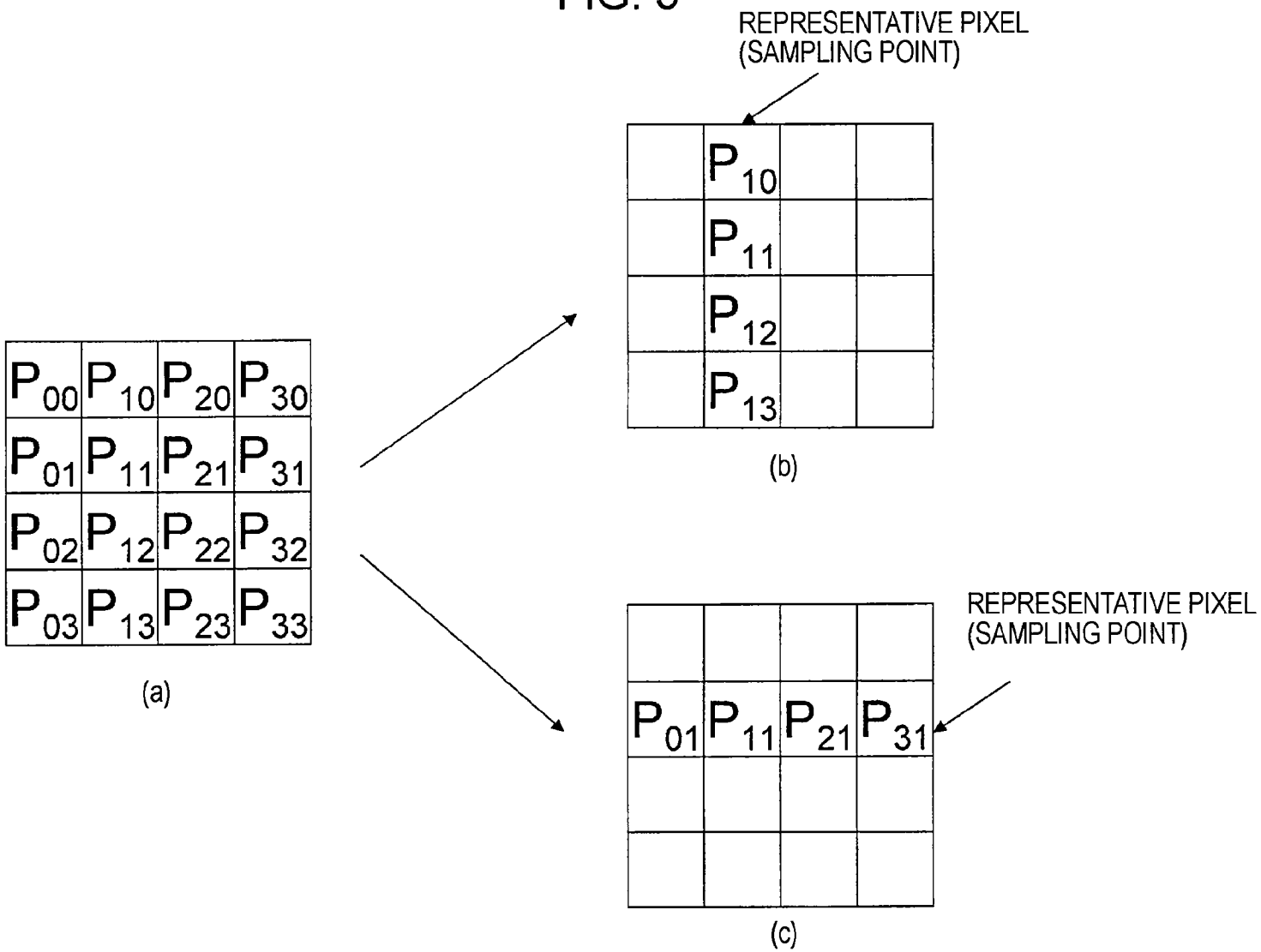
FIG. 5 illustrates an example of a spatial thinning process to be performed by a spatial thinning processor.

A description will now be given, with reference to FIG. 5, of an example of a spatial thinning process to be performed by the spatial thinning processor 213. FIG. 5 shows pixel blocks forming the input image. When the block is composed of 4×4 pixels as shown in part (a) of FIG. 5, in the spatial thinning in the horizontal direction, as shown in part (b) of FIG. 5, only one pixel value is selected from among four pixels in the horizontal direction and is made to be a representative value. In the example in part (b) of FIG. 5, only $P_{10}$ among the four pixels of $P_{00}$ to $P_{30}$ is made effective as a representative value (sampling point). The other pixel values are made ineffective. Similarly, for the four pixels of $P_{01}$ to $P_{31}$, $P_{11}$ is made to be a representative value (sampling point); for the four pixels of $P_{02}$ to $P_{32}$, $P_{12}$ is made to be a representative value (sampling point); and for the four pixels of $P_{03}$ to $P_{33}$, $P_{13}$ is made to be a representative value (sampling point).

In the spatial thinning in the vertical direction, as shown in part (c) of FIG. 5, one pixel value among the four pixels in the vertical direction is made effective as a sampling point. In the example in part (c) of FIG. 5, only $P_{01}$ among the four pixels of $P_{00}$ to $P_{03}$ is made effective as a sampling point. The other pixels are made ineffective. Similarly, for the four pixels of $P_{10}$ to $P_{13}$, $P_{11}$ is made to be a sampling point; for the four pixels of $P_{20}$ to $P_{23}$, $P_{21}$ is made to be a sampling point; and for the four pixels of $P_{30}$ to $P_{33}$, $P_{31}$ is made to be a sampling point.

The spatial thinning processor 213 performs such a thinning process in the spatial direction by setting a sampling point in various forms with respect to each of a plurality of continuous frames generated on the basis of a still image. As a result of performing such a spatial thinning, a super-resolution effect is obtained in the scroll display image of the frame image displayed on the image display section 4, and an image having a resolution exceeding the resolution level possessed by the display device can be displayed. As a result of the spatial thinning process being performed by the spatial thinning processor 213, the image is converted into image data having a desired number of pixels p×q supplied from the controller 3. As a result of displaying the image having a number of pixels p×q after the thinning process at the scrolling velocities Vx and Vy input to the controller 3, the spatial resolution perceived by an observer is improved on the basis of the super-resolution effect. At this time, the spatial resolution perceived by the observer corresponds to Dxp×Dyq pixels in which the number of display pixels p×q in the X direction becomes Dx times as high and that for the Y direction becomes Dy times as high.

In the above example of the processing, the following process has been described. With respect to the case in which the number of pixels m×n of the input image is greater the number of pixels [Dxp×Dyq] computed on the basis of the amounts of spatial thinning Dx and Dy necessary for obtaining the super-resolution effect and on the basis of the second number of pixels p×q that is generated finally, after a process for converting into the first number of pixels Dxp×Dyq pixels is performed by the process in the spatial filtering processor 212, a spatial thinning process in the spatial thinning processor 213 is performed to convert the number of pixels into p×q pixels.

However, when the number of pixels m×n of the input image is smaller than the number of pixels [Dxp×Dyq] computed on the basis of the amounts of spatial thinning Dx and Dy necessary for obtaining a super-resolution effect and the second number of pixels p×q that is generated finally, the spatial filtering processor 212 performs a process for expanding the input image.

Figure 6:
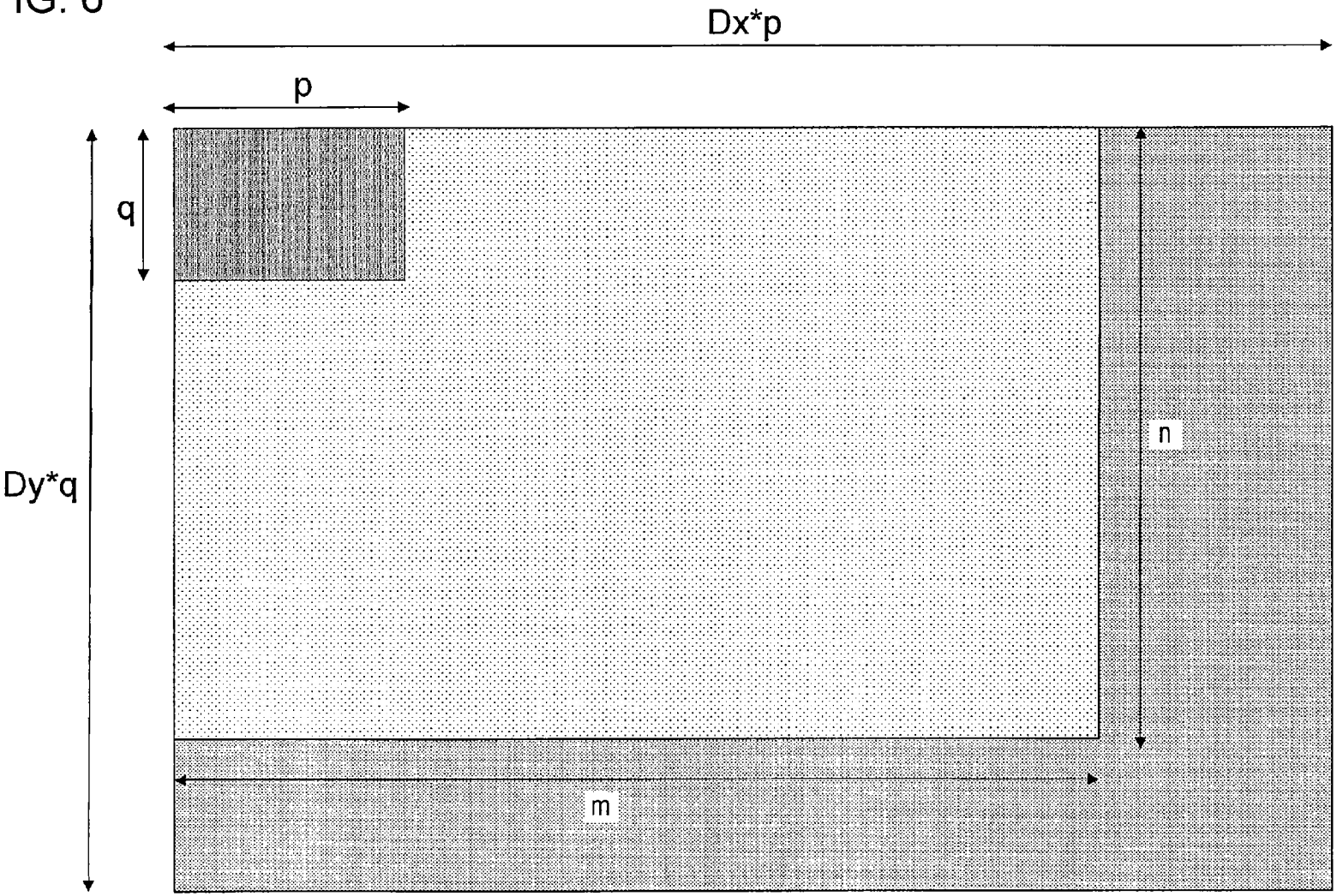
FIG. 6 illustrates a number-of-pixel conversion process to be performed by an image converter.

FIG. 6 shows a relationship among images. FIG. 6 shows a correspondence among pixel structures of an input image having a number of pixels m×n, an image of a first number of pixels Dxp×Dyq, and an image of a second number of pixels p×q.

The number of pixels m×n of the input image is smaller than the first number of pixels Dxp×Dyq of the image. In this case, the spatial filtering processor 212 performs a process for expanding the input image so that the number of pixels of the input image having the number of pixels m×n is converted into the first number of pixels Dxp×Dyq. Then, in the spatial thinning processor 213, the number of pixels of the first number of pixels Dxp×Dyq is converted into the second number of pixels p×q.

In the manner described above, also in this case, number-of-pixel conversion is performed in two steps.

In the case of this setting, for the spatial filtering process to be performed by the spatial filtering processor 212, an expansion process is performed. Therefore, as a result of displaying the image having the number of pixels p×q after the thinning process at the specified scrolling velocities Vx and Vy, the spatial resolution that can be perceived by the observer is improved, but the perceived spatial resolution does not exceed the equivalent of m×n pixels. In other words, in the case of the image relationship shown in FIG. 6, that is, in the case of m<Dxp and n<Dyq, when the scroll image after the thinning process is displayed, the spatial resolution that can be perceived by the observer becomes the equivalent of m×n pixels.

The same applies to the case in which, with respect to the X direction and the Y direction, the number of pixels of the input image is smaller than the first number of pixels after the spatial filtering process (m<Dxp or n<Dyq). When m<Dxp and n≧Dyq, when the scroll image after the thinning process is displayed, the spatial resolution that can be perceived by the observer becomes the equivalent of m×Dyq pixels. When m≧Dxp and n<Dyq, the spatial resolution becomes the equivalent of Dxp×n pixels.

A description will now be given of the amount of spatial thinning in the spatial thinning process to be performed by the spatial thinning processor 213. In the spatial thinning processor 213, as described above, the conversion of the first number of pixels Dxp×Dyq into the second the number of pixels p×q is performed. Here, the amounts of spatial thinning Dx and Dy are values computed, as the amounts of spatial thinning Dx and Dy for obtaining the super-resolution effect, by the controller 3 on the basis of the movement velocities Vx and Vy of the scroll image, which are input from the parameter input section 12. On the basis of the amounts of spatial thinning Dx and Dy, the spatial thinning processor 213 performs number-of-pixel conversion from the first number of pixels Dxp×Dyq into the second number of pixels p×q.

Figure 7:
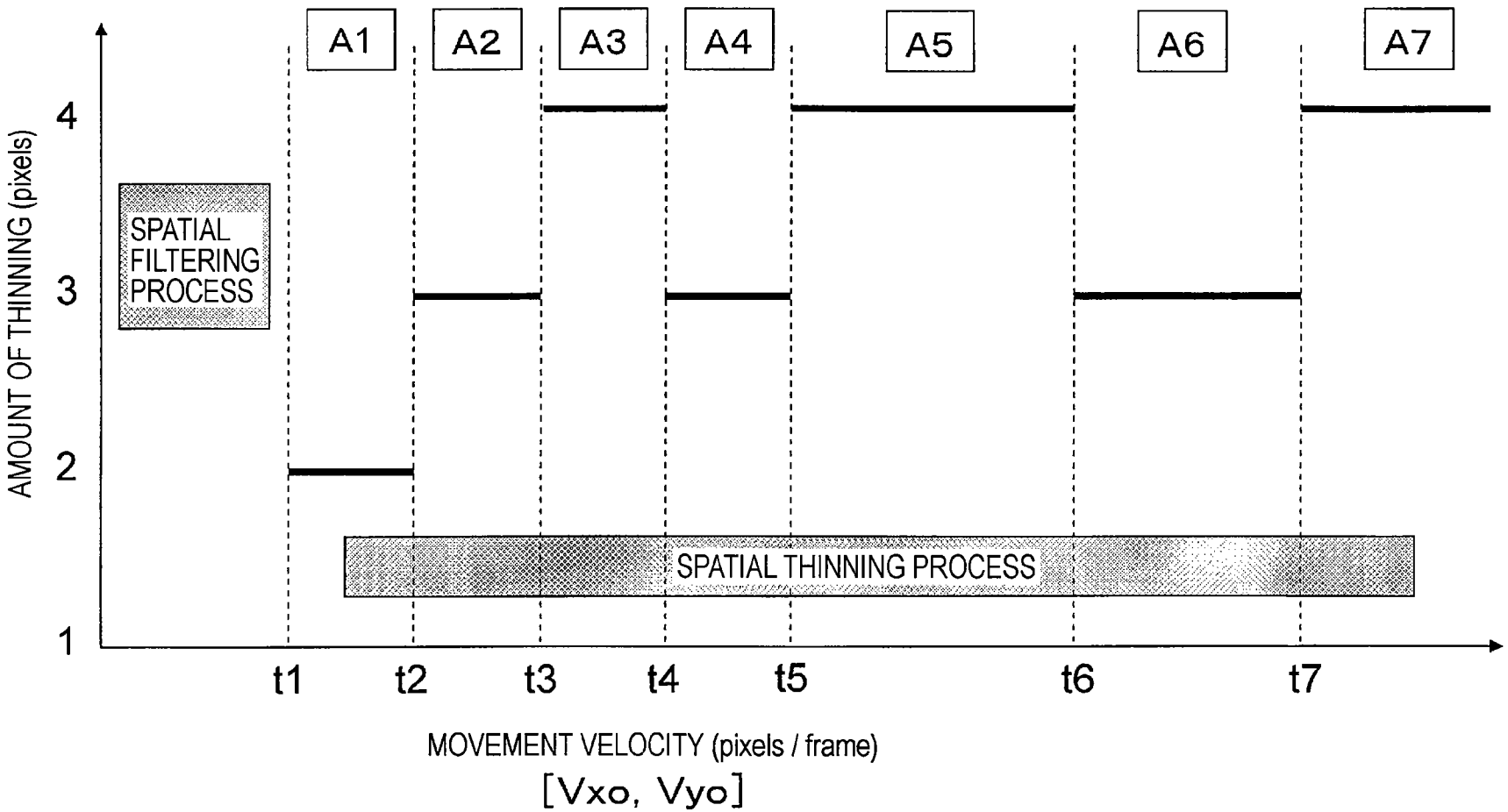
FIG. 7 illustrates an amount of thinning in a spatial thinning process to be performed by the spatial thinning processor.

FIG. 7 shows the relationship between the movement velocity of the image and the amounts of thinning that satisfy conditions under which the super-resolution effect is obtained. For the sake of simplicity of description, in FIG. 7, an example in which the maximum amount of thinning is 4 is shown. Alternatively, a configuration that supports thinning of 5 or more under the conditions in which the super-resolution effect is obtained in response to the display frame rate of the image processing apparatus 4 is also possible.

The value of the movement velocity in the horizontal axis in FIG. 7 does not directly indicate the scrolling velocities Vx and Vy input by the user via the interface section 12. The scrolling velocities Vx and Vy indicate how many pixels the scroll image is moved per frame when the image is actually displayed by the image display section 4. These are the movement velocities of the image after all the number-of-pixel conversion processes are performed (this is synonym with the "image after the thinning process"). On the other hand, the value of the movement velocity in the horizontal axis in FIG. 7 is a speed corresponding to the movement of the image before the thinning process. When the movement velocities of the image after the thinning process are Vx and Vy, the movement velocities of the image before the thinning process correspond to the values of the products VxDx and VyDy of the movement velocity of the image after being thinned and the amount of thinning.

Hereinafter, speeds corresponding to the movement velocity of the image before the thinning process are referred to as movement velocities Vxo and Vyo of the image before the thinning process and are used for descriptions. The unit of the movement velocities Vxo and Vyo of the image before the thinning process is pixels/frame. The following are satisfied: Vxo=VxDx, and Vyo=VyDy.

For this reason, FIG. 7 shows that the movement in the X-axis direction means the correspondence between Vxo in the horizontal axis and Dx in the vertical axis and the movement in the Y-axis direction means the correspondence between Vyo in the horizontal axis and Dy in the vertical axis. t1 to t7 shown in the horizontal axis in FIG. 7 are threshold values by which the movement velocity is divided into areas of A1 to A7. In the following, for example, when the movement velocity Vxo is t4≦Vxo<t5, it is represented that "Vxo is present in the area of A4".

A description will now be given of the relationship between the movement velocity and the amount of thinning that satisfies the conditions under which the super-resolution effect is obtained, shown in FIG. 7, and of the relationship between the spatial filtering process and the spatial thinning process with respect to the amount of thinning.

First, a description will be given of the relationship between the movement velocities Vxo and Vyo of the image before the thinning process and the amount of thinning that satisfies the conditions under which the super-resolution effect is obtained, shown in FIG. 7. Here, for the sake of simplicity of description, a description is given of an image that moves only in the X direction (Vxo≠0). In this case, the resolution conversion in the Y direction is not performed by the spatial thinning processor 213, and is entirely performed in the spatial filtering process. In this case, Vy=0 and Vyo=0. It can also be seen from FIG. 7 that the resolution conversion for the Y direction is entirely performed in the spatial filtering process. When the movement velocity Vxo is smaller than the threshold value t1, since the super-resolution effect is not obtained, the amount of thinning is 1, and the conversion of the number of pixels is performed by only the spatial filtering process.

Next, a description will be given, with reference to FIG. 7, of the amount of thinning in the X direction for the spatial thinning processor 213, which should be performed in response to each value of the movement velocity Vxo of the image before the thinning process.

(a) When the Movement Velocity Vxo is t1≦Vxo<t2

That is, when the movement velocity Vxo is present in the area A1 shown in FIG. 7, the amount of thinning for obtaining the super-resolution effect is 2.

In this case, first, the resolution is converted into 2p×q pixels by the spatial filtering process, and the image after the conversion is converted into p×q pixels by the spatial thinning process for sampling every two other pixels.

(b) When Movement Velocity Vxo is t2≦Vxo<t3

That is, when the movement velocity Vxo is present in the area A2 shown in FIG. 7, the amount of thinning for obtaining the super-resolution effect is 3.

In this case, the resolution is first converted into 3p×q pixels by the spatial filtering process, and the image after the conversion is converted into p×q pixels by the spatial thinning process for sampling every three other pixels.

(c) When the Movement Velocity Vxo is t3≦Vxo<t4

That is, when the movement velocity Vxo is present in the area A3 shown in FIG. 7, the amount of thinning for obtaining the super-resolution effect is 4.

In this case, the resolution is first converted into 4p×q pixels by the spatial filtering process, and the image after the conversion is converted into p×q pixels by the spatial thinning process for sampling every four other pixels.

(d) When the Movement Velocity Vxo is t4≦Vxo<t5

That is, when the movement velocity Vxo is present in the area A4 shown in FIG. 7, the amount of thinning for obtaining the super-resolution effect is 3.

In this case, the resolution is first converted into 3p×q pixels by the spatial filtering process, and the image after the conversion is converted into p×q pixels by the spatial thinning process for sampling every three other pixels.

In addition, when the movement velocity Vxo is present in the area A5, the same applies to that when the movement velocity Vxo is present in the area A3. When the movement velocity Vxo is present in the area A6, the same applies to that when the movement velocity Vxo is present in the area A4. When the movement velocity Vxo is present in the area A7, the same applies to that when the movement velocity Vxo is present in the area A3. In the manner described above, the number of pixels of the image that is output after the resolution conversion by the spatial filtering process is determined on the basis of the relationship between the magnitude of the movement velocity and the amount of spatial thinning, shown in FIG. 7.

However, in the number-of-pixel conversion process in this embodiment, the value of the scrolling velocity Vx after the thinning process is known, and the amount of thinning Dx is unknown. Therefore, the movement velocity Vxo=VxDx of the image before the thinning process is unknown. Under these conditions, it is necessary for the controller 3 to determine the amount of thinning Dx with which the super-resolution effect is obtained. A description will be given below of a method for determining the amount of thinning in the controller 3.

First, a description is given below of a method for determining the amount of thinning Dx with respect to a case in which, in the interface section 12, the user inputs the value of the scrolling velocity Vx with a multiple choice method by using the user interface (GUI) described with reference to FIG. 2 above.

For this case, with respect to the scrolling velocity to be selected by the user using the GUI, the value of the amount of spatial thinning Dx, which corresponds to each choice, is determined in advance. As described above, when the image after the spatial thinning process is scroll-displayed, the spatial resolution that can be perceived by the observer is the equivalent of the pixels of the product of the number of display pixels [Dxp×Dyq] (with the number of pixels of the input image being an upper limit) on the basis of the principles of the super-resolution. For this reason, when a process employing the value of the amount of thinning [Dx and Dy] as large as possible, the spatial resolution that can be perceived by the observer is improved.

When the relationship between the movement velocity Vxo of the image before being thinned and the amount of thinning Dx is as shown in FIG. 7, the maximum amount of thinning is set to 4 in this example. The amount of spatial thinning Dx can typically be set to 4 if choices for determining the scrolling velocity Vx are set within the range in which Vx falls within one of the areas of A3, A5, and A7 in FIG. 7, that is, in which the value of the movement velocity Vxo=4Vx of the image before the thinning process falls within one of the areas of A3, A5, and A7 in FIG. 7.

In the manner described above, when it is possible for the user to input a value of the scrolling velocity with a multiple choice method, the value of the amount of thinning can be determined in advance in response to the choice of the movement velocity. By allowing the controller 3 to have this information, it is possible to control the spatial filtering process and the spatial thinning process.

That is, when there is a relationship between the movement velocity Vxo and the amount of thinning Dx of the image before being thinned, shown in FIG. 7, only in the case of Vxo=t3 to t4, t5 to t6, and t7 . . . , the amount of thinning in the X direction is set as Dx=4. Therefore, as permissible values of the speed Vx in the X direction, which can be set by the user interface shown in FIG. 2, only the following values can be set on the basis of Vxo=4Vx:

$$Vx=(t3 \text{ to } t4)/4, \quad \text{a)}$$

$$Vx=(t5 \text{ to } t6)/4, \text{ and} \quad \text{b)}$$

$$Vx=(t7 \ldots)/4. \quad \text{c)}$$

As a result, it is possible for the user to set one of a) to c) above as the scrolling velocity Vx in the X direction and to generate a thinned image that brings about a super-resolution effect by means of thinning in the spatial direction using the amount of thinning Dx=4 in the spatial direction in accordance with this setting. The same applies to the amount of thinning in the Y direction and the scrolling velocity Vy.

When there is a relationship between the movement velocity Vxo of the image before being thinned and the amount of thinning Dx, shown in FIG. 7, the following are determined:

when Vxo=t3 to t4, t5 to t6, or t7 . . . , the amount of thinning in the X direction Dx=4, when Vxo=t1 to t2, the amount of thinning in the X direction Dx=2, and when Vxo=t2 to t3, t4 to t5, or t6 to t7, the amount of thinning in the X direction Dx=3.

Therefore, only the following values Vx may be set:

$$Vx=(t3 \text{ to } t4)/4, \quad \text{a)}$$

$$Vx=(t5 \text{ to } t6)/4, \quad \text{b)}$$

$$Vx=(t7 \ldots)/4, \quad \text{c)}$$

$$Vx=(t1 \text{ to } t2)/2, \quad \text{d)}$$

$$Vx=(t2 \text{ to } t3)/3, \quad \text{e)}$$

$$Vx=(t4 \text{ to } t5)/3, \text{ and} \quad \text{f)}$$

$$Vx=(t6 \text{ to } t7)/3, \text{ so that} \quad \text{g)}$$

when the scrolling velocity Vx selected by the user is one of a) to c) above, the amount of thinning in the spatial direction is set as Dx=4, when the scrolling velocity Vx is d) above, the amount of thinning in the spatial direction is set as Dx=2, and when the scrolling velocity Vx is one of e) to g) above, the amount of thinning in the spatial direction is set as Dx=3, and processing is performed.

For example, the configuration may be formed in such a way that a correspondence table of the GUI set movement velocity and the amount of spatial thinning, shown in FIG. 8, is held; on the basis of this table, the controller 3 determines the amount of thinning in the spatial direction on the basis of the scrolling velocity input by the user via the GUI; and on the basis of the determined amount of thinning, the spatial thinning processor 213 performs the thinning process. FIG. 8 shows a correspondence between the scrolling velocity Vx in the X direction and the amount of thinning Dx. The same applies to the scrolling velocity Vy in the Y direction and the amount of thinning Dy in the Y direction.

On the other hand, when setting is made such that the user can input the values of any desired scrolling velocities Vx and Vy in the interface section 12, on the basis of the scrolling velocities Vx and Vy input in the controller 3, the amounts of thinning Dx and Dy are computed. The amount of thinning in the spatial thinning process is determined by the controller 3 each time the input scrolling velocity is changed in response to the value of the scrolling velocity input to the controller 3.

As described above, when a value as large as possible is obtained for the amount of thinning, the spatial resolution that can be perceived by the observer is improved. The relationship between the movement velocity and the amount of thinning is shown in FIG. 7, and it is assumed that the maximum amount of thinning is set to 4.

A description will now be given of a method in which the value of the scrolling velocity in the X direction, which is input by the user, is denoted as Vx, and the amount of thinning Dx is determined by using the relationship data shown in FIG. 7. First, when it is assumed that the amount of spatial thinning Dx=4, the value of Vxo corresponding to the horizontal axis in FIG. 7 becomes Vxo=4Vx.

On the basis of the value Vx of the scrolling velocity in the X direction, which is input by the user, the controller 3 computes Vxo=4Vx under the assumption of the amount of thinning in the x direction Dx=4. Here, when the computed Vxo=4Vx is in the range of the movement velocity area in which the super-resolution effect is obtained with the amount of thinning 4, that is, in the range of the area of A3, A5, or A7 in FIG. 7, this assumption is assumed to be correct, and the amount of thinning Dx is determined as 4.

That is, when Vxo=4Vx=t3 to t4, t5 to t6, or t7 . . . , the amount of thinning Dx in the x direction is determined as 4.

When Vxo=4Vx computed on the basis of the value of the scrolling velocity Vx in the x direction, which is input by the user, Vxo=4Vx≠t3 to t4, t5 to t6, or t7 . . . , it is determined that the assumption of the amount of thinning in the x direction Dx=4 is incorrect.

Next, Vxo=3Vx is computed under the assumption of the amount of thinning in the x direction Dx=3. Here, if the computed Vxo=3Vx is in the range of the movement velocity area in which the super-resolution effect is obtained with the amount of thinning 3, that is, in the range of the area of A2, A4, or A6 in FIG. 7, this assumption is assumed to be correct, and the amount of thinning Dx is determined as 3.

That is, when Vxo=3Vx=t2 to t3, t4 to t5, or t6 to t7, the amount of thinning in the x direction is determined as Dx=3.

Next, when Vxo=3Vx computed on the basis of the value Vx of the scrolling velocity in the x direction, which is input by the user, is Vxo=3Vx≠t2 to t3, t4 to t5, or t6 to t7, the assumption of the amount of thinning in the x direction Dx=3 is assumed to be incorrect.

Next, Vxo=2Vx is computed under the assumption of the amount of thinning in the x direction Dx=2. Here, if the computed Vxo=2Vx is in the range of the movement velocity area in which the super-resolution effect is obtained with the amount of thinning 2, that is, is in the range of the area of A1 in FIG. 7, this assumption is assumed to be correct, and the amount of thinning is determined as Dx=2.

That is, when Vxo=2Vx=t1 to t2, the amount of thinning Dx in the x direction is determined as Dx=2.

Next, Vxo=2Vx computed on the basis of the value Vx of the scrolling velocity in the x direction, which is input by the user, Vxo=2Vx≠t1 to t2, the amount of thinning Dx is determined as 1. When the amount of thinning Dx=1, conversion of the number of pixels is performed only in the spatial filtering process.

When the assumed amount of thinning is decreased by 1 starting from the maximum amount of thinning and a match with conditions under which the super-resolution effect is obtained is made, the amount of spatial thinning Dx is determined. This determination of the amount of spatial thinning is performed by the controller 3, and the controller 3 controls the spatial filtering process and the spatial thinning process on the basis of the determined value.

Figure 9:
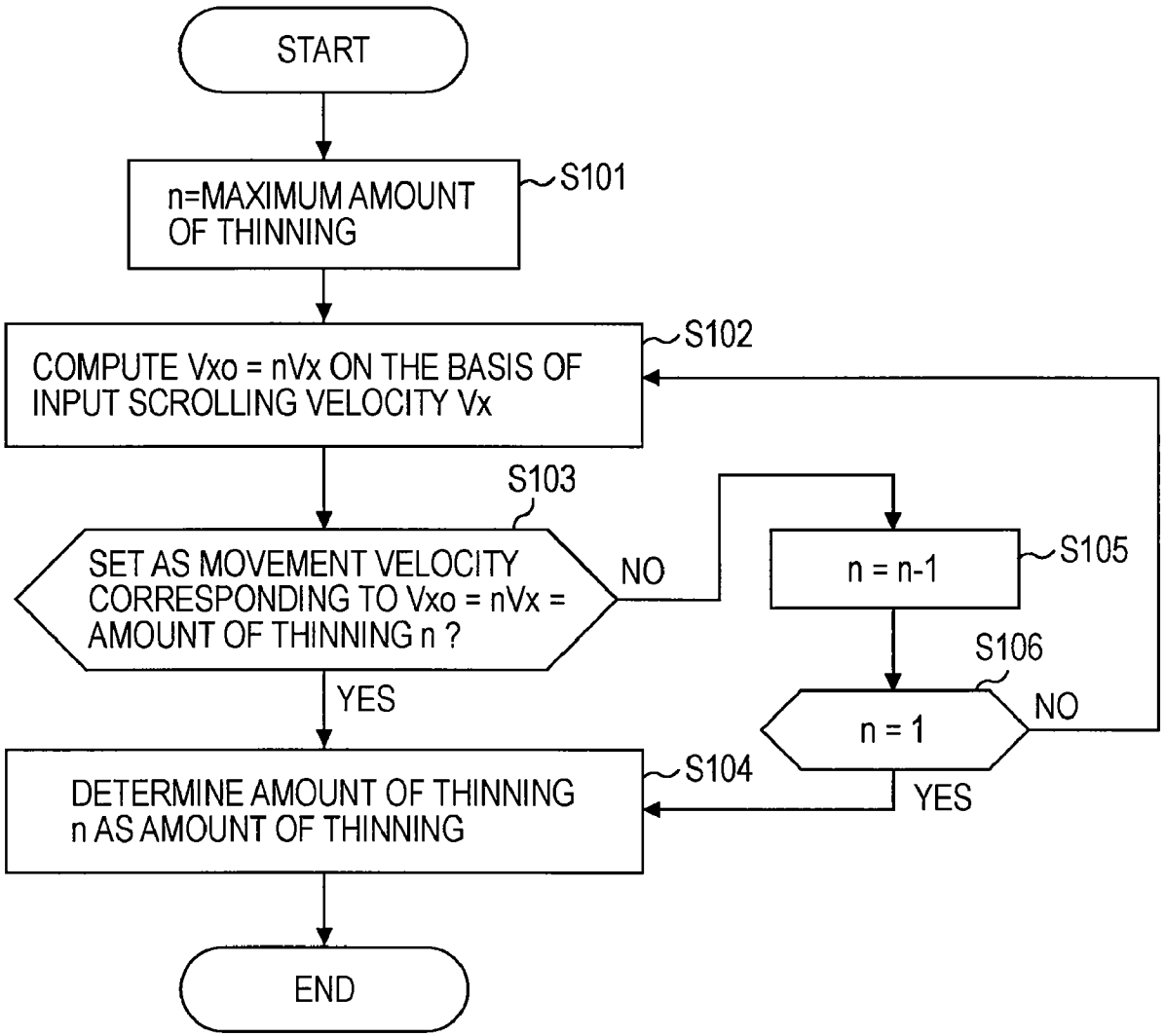
FIG. 9 is a flowchart illustrating a sequence of determining the amount of thinning in a spatial thinning process to be performed by the spatial thinning processor.

The above-described processing sequence for determining the amount of spatial thinning will be described with reference to the flowchart shown in FIG. 9. Initially, in step S101, a variable n is set as a predetermined maximum amount of thinning. For example, in the setting shown in a graph of FIG. 7, n is set to 4.

Next, in step S102, Vxo=nVx is computed on the basis of the scrolling velocity Vx input via the user interface. Next, in step S103, it is determined whether or not Vx is set as a movement velocity corresponding to Vxo=Vx=the amount of thinning n. For this determination, for example, the relationship data of the movement velocity Vxo of the image before being thinned and the amount of thinning Dx, shown in FIG. 7, is used. This data is, for example, formed as a table and is stored in a storage section, and is used.

When the determination in step S103 as to whether Vx is set as a movement velocity corresponding to Vxo=Vx=the amount of thinning n is Yes, the process proceeds to step S104, where the amount of thinning n is determined as an amount of thinning to be used in the spatial thinning process.

When the determination in step S103 as to whether Vx is set as a movement velocity corresponding to Vxo=Vx=the amount of thinning n is No, the process proceeds to step S105, where updating of the variable n=n−1 is performed. In step S106, a determination is made as to whether or not n=1. When n is not 1, processing of step S102 and subsequent steps is repeated. When it is determined in step S106 that n=1, n=1 is determined as an amount of thinning.

As a result of this processing, processing for correctly selecting a largest value of spatial thinning with priority is realized. In the foregoing, the movement velocity in the X direction and the amount of thinning have been described. Identical processing is performed with respect to the movement velocity in the Y direction and the amount of thinning.

When the image has a movement velocity that is not 0 for both the X direction and the Y direction, the amount of thinning in the spatial thinning process can be obtained from FIG. 7 with respect to each of the X direction and the Y direction. On the basis of the obtained amount of spatial thinning, the controller 3 controls the number-of-pixel conversion process by the spatial filtering processor 212 and the spatial thinning processor 213.

Figure 10:
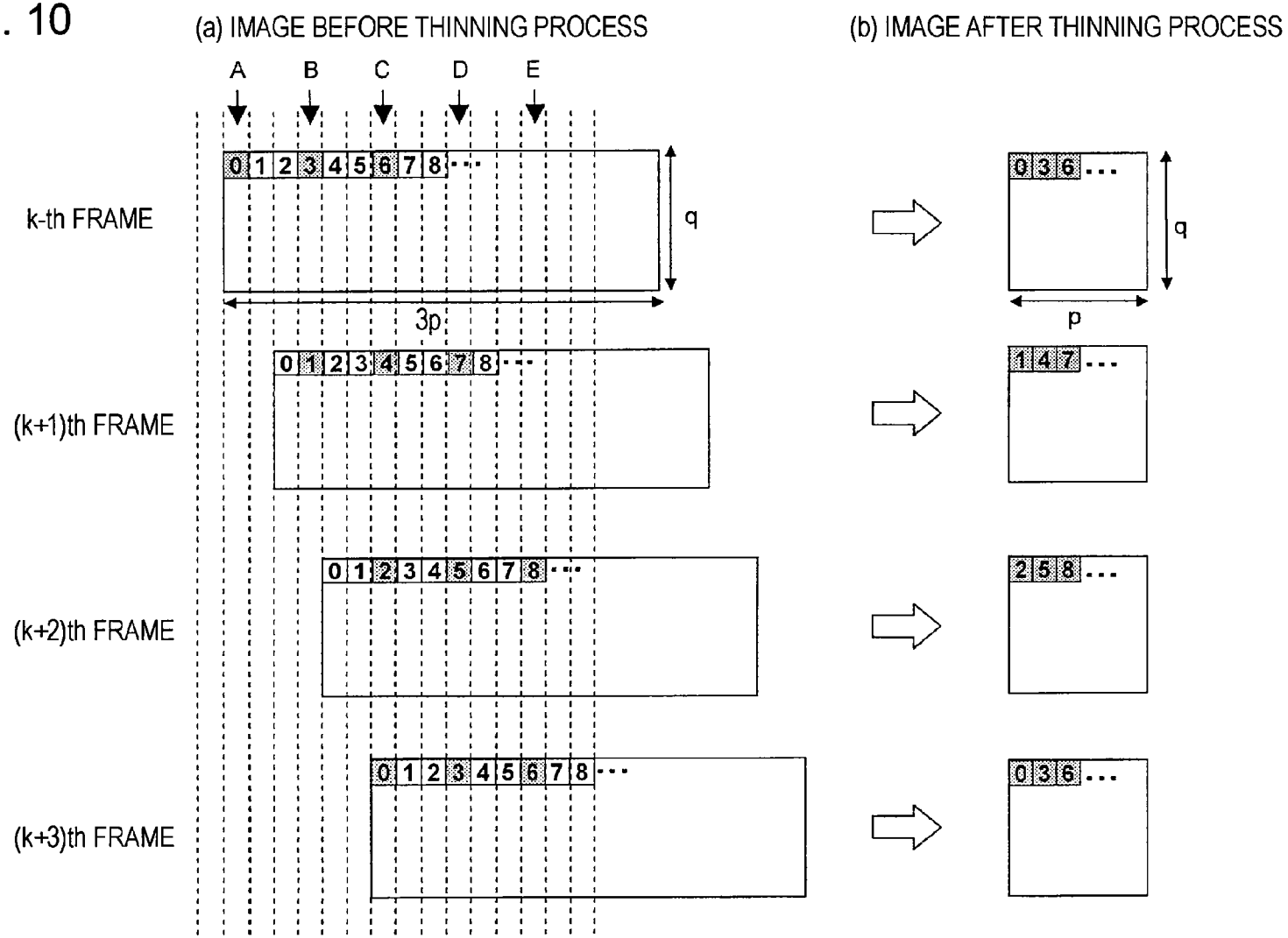
FIG. 10 illustrates a specific example of a spatial thinning process to be performed by the spatial thinning processor, and a generated image.

Next, details of the thinning process will be described below with respect to the spatial thinning process to be performed by the spatial thinning processor 213. FIG. 10 illustrates a specific example showing the thinning position in the spatial thinning process. By using the example of FIG. 10, the positions of the pixels to be sampled in the thinning process are described below.

Part (a) of FIG. 10 shows an image of the k-th to (k+3)th frames of the image before being thinned. Part (b) of FIG. 10 shows an image of the k-th to (k+3)th frames after the thinning process. In the image of the k-th to (k+3)th frames before the thinning process in part (a) of FIG. 10, specific pixels are extracted as representative pixels (sampling pixels). Then, an image of the k-th to (k+3)th frames after the thinning process of part (b) of FIG. 10 is generated by the sampling pixels and is output.

In the example of the processed image shown in FIG. 10, the scrolling velocity is a parameter input by the user by using the GUI shown in FIG. 2, and it is assumed that the specified scrolling velocities Vx and Vy in the X and Y directions are Vx=⅔ (pixels/frame) and Vy=0 (pixels/frame), respectively. That is, it is assumed that scroll setting that moves at ⅔ (pixels/frame) for only the X direction has been performed.

For the amount of spatial thinning, it is assumed that Dx=3 is selected as a value that satisfies the conditions under which the super-resolution effect is obtained with respect to the movement in the X direction. Since Vy=0, Dy=0.

The resolution of the still image data signal having m×n pixels to be processed is converted by the spatial filtering processor 212 before the image is input to the spatial thinning processor 213 shown in FIG. 3. The image has been converted into an image of Dxp×Dyq pixels, that is, image data of the 3p×q pixels. As a result of being thinned by the spatial thinning processor 213, the image has p×q pixels.

At this time, the movement velocity Vxo of the image before the thinning process is Vxo=VxDx=(⅔)×3=2 (pixels/frame). Since Vy=0, Vyo=0.

A description will now be given, with reference to FIG. 10, of the position of a sampling pixel selected in a spatial filtering process to be performed in the spatial thinning processor 213. The pixel to be sampled by a thinning process depends on which frame of the scroll image the image frame to be processed is in addition to the movement velocity and the amount of thinning.

FIG. 10 shows image data corresponding to four continuous k-th to (k+3)th frames that are scroll-displayed. k is a positive integer. Part (a) of FIG. 10 shows the positions of pixels to be sampled in the image of the k-th to (k+3)th frames before the thinning process.

With respect to each frame, a thinning process is performed under the assumption that the image is moving at the movement velocity Vxo of the image before the thinning process, which is computed on the basis of the scrolling velocity Vx specified by the user. As described above, since Vxo=VxDx=(⅔)×3=2 (pixels/frame), each time the frame is moved by one, the image is shown by being moved by two pixels in the X direction. The processing image is one still image. The image displayed on the image display section 4 shown in FIG. 1 is processed in units of output frames generated on the basis of one still image.

In FIG. 10, 0, 1, 2, and . . . 8, . . . each indicate one pixel. Positions A, B, and C indicate sampling pixel positions when the amount of thinning Dx=3 in the X direction.

For example, in the "image before the thinning process" of the k-th frame shown in part (a) of FIG. 10, pixels to which numbers 0, 3, and 6 at the positions A, B, and C are assigned are assumed as sampling pixels. In this embodiment, since the amount of thinning in the X direction Dx=3, in the image of each of the k-th, k+1, and k+2 . . . frames, only one pixel is obtained as a sampling pixel from among the three pixels in the X direction. That is, a compressed image in which only ⅓ of pixel data in the X direction is selected is generated. In the example shown in FIG. 10, in the k-th frame, pixels 0, 3, and 6 . . . are selected as sampling pixels, in the (k+1)th frame, pixels 1, 4, and 7 . . . are selected as sampling pixels, in the (k+2)th frame, pixels 2, 5, and 8 . . . are selected as sampling pixels, and in the (k+3)th frame, pixels 0, 3, and 6 . . . are selected as sampling pixels.

That is, with respect to each frame, pixels to be sampled are changed, and sampling is performed every three other pixels, thereby generating an "image after the thinning process" and outputting this image from the spatial thinning processor 213. As shown in the image after the thinning process in part (b) of FIG. 10, images are sequentially output from the spatial thinning processor 213 in such a manner that the image of the (k+1)th frame after the thinning process is composed of pixels 1, 4, and 7 . . . , the image of the (k+2)th frame after the thinning process is composed of pixels 2, 5, and 8 . . . , and the image of the (k+3)th frame after the thinning process is composed of pixels 0, 3, and 6 . . . .

The thinning process involving the change of the sampling point is a process for generating a super-resolution effect when an image to be output to the image display section 4 is moved at a fixed scroll velocity. In the (k+1)th frame next to the k-th frame, pixels are sampled by assuming that the "image before the thinning process" of part (a) of FIG. 10 is moved in the X direction by Vxo pixels (2 pixels in this example) in comparison with that in the k-th frame.

At the position A shown in the "image before the thinning process" of part (a) of FIG. 10, in the (k+1)th frame, no pixels exist as a result of the movement of the frame. Therefore, sampling is performed every three other pixels in the order of positions B, C, and D (in the order of pixels 1, 4, and 7). Thus, an "image after the thinning process" is generated and is output from the spatial thinning processor 213.

In the next (k+2)th frame, sampling is performed by assuming that the "image before the thinning process" is moved in the X direction by Vxo pixels (2 pixels in this example) in comparison with the (k+1)th frame. Since no pixels exist at the position B, pixels are sampled in the order of positions C, D, and E (in the order of pixels 2, 5, and 8). Thus, an "image after the thinning process" is generated and is output from the spatial thinning processor 213.

In the next (k+3)th frame, pixels are sampled by assuming that the "image before the thinning process" is moved in the X direction by Vxo pixels (2 pixels in this example) in comparison with that in the (k+2)th frame. Pixels are sampled every three other pixels in the order of positions C, D, and E (in the order of pixels 0, 3, and 6), and an "image after the thinning process" is generated and is output from the spatial thinning processor 213.

Hereinafter, in an identical procedure, by assuming that the "image before the thinning process" is moving at the movement velocity Vxo, a thinned sampling process is performed on all the frames necessary for the display of the scroll image, generating an "image after the thinning process" and outputting the image from the spatial thinning processor 213.

In the example shown in the "image after the thinning process" in part (b) of FIG. 10, the output results of the k-th frame and the (k+3)th frame becomes the same, with the result that, in the subsequent frames, the "images after the thinning process" of three patterns are repeatedly output. However, such a repeated pattern is not always formed in response to the relationship between the movement velocity and the amount of thinning.

In the example shown in FIG. 10, a case has been considered in which the image is moved only in the X direction for the sake of simplicity of description. Identical processing is also performed in response to each movement direction with respect to a case in which the image is moved only in the Y direction and with respect to a case in which the image has a movement velocity that is not 0 for both the X direction and the Y direction.

Furthermore, in the example of FIG. 10, the movement velocity corresponding to the image before being thinned is:

Vxo=2 (pixels/frame) for the X direction, and

Vyo=0 (pixels/frame) for the Y direction.

An example in which both the movement velocities are integer values is described. However, when at least one of Vxo and Vyo is not an integer value, in the spatial thinning process, pixel values need to be sampled in the coordinates of the subpixel accuracy. In this case, rather than performing sampling in units of one pixel, it is necessary to extract a pixel area selected from a portion of one pixel or a plurality of pixels. In this case, there are cases in which the pixel value of the pixel needs to be corrected. When this correction pixel value is to be computed, an interpolation method, such as 4-neighborhood linear interpolation, 2-neighborhood linear interpolation, or closest interpolation, may be used. Of course, another higher-order or lower-order interpolation method may be used as an interpolation calculation method.

Up to this point, a description has been given of processing performed by the number-of-pixel converter 21. As a result of performing a conversion process in the above-described procedure, when the output image having p×q pixels is displayed as each frame of the image that is scrolled on the screen at the specified movement velocities Vx and Vy, the image is perceived by the observer at the spatial resolution corresponding to Dxp×Dyq pixels (with the spatial resolution corresponding to m×n pixels being an upper limit) by making a full use of the super-resolution effect in the human being's vision system.

The image signal having p×q pixels, which is output from the spatial thinning processor 213, as shown in FIG. 3, is input to the rendering section 221 in the display image generator 22. In the rendering section 221, a rendering process is performed on the input image signal under the control of the controller 3, and a display image signal having the same number of pixels as the number of pixels possessed by the display device forming the image display section 4 is generated.

Figure 11:
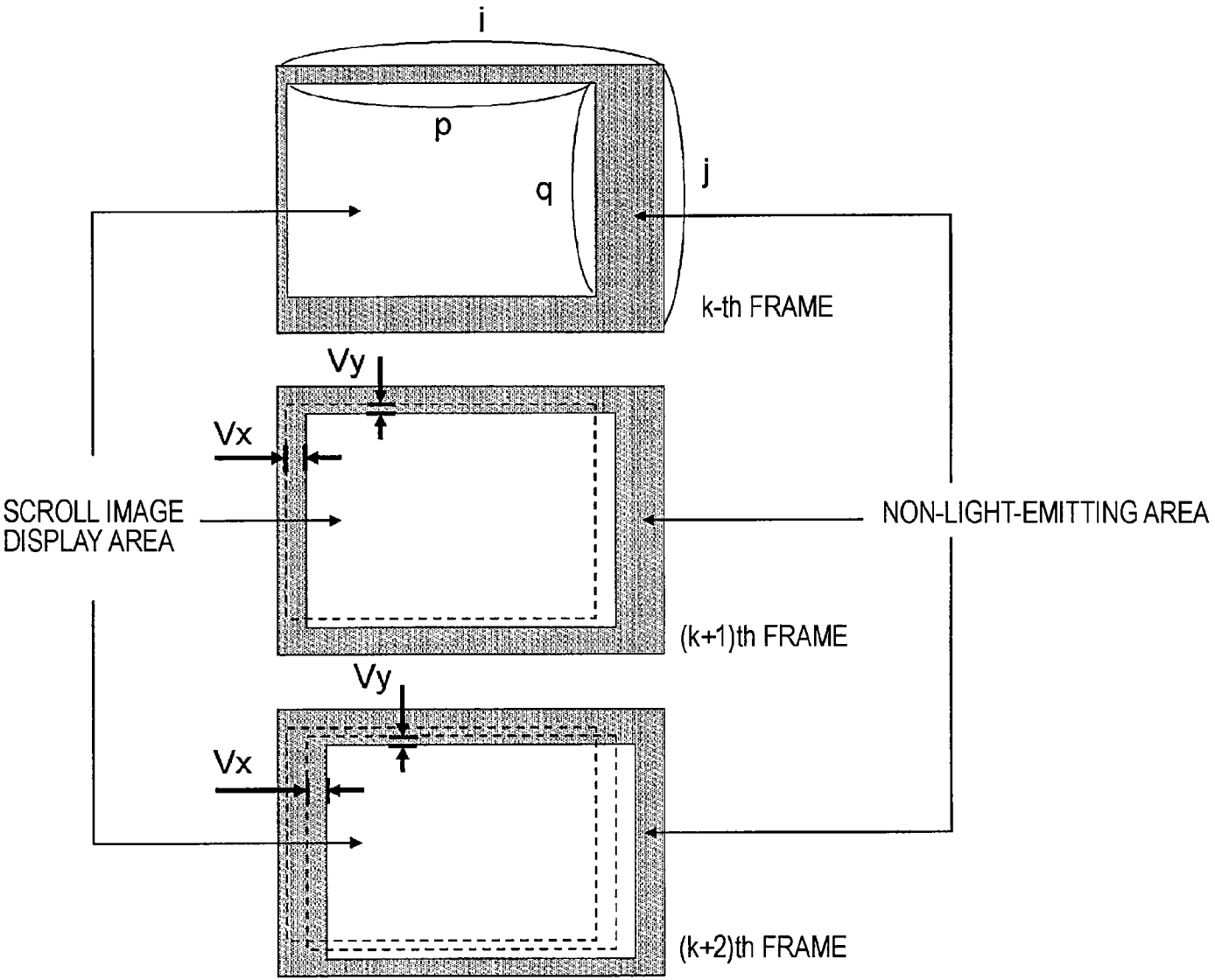
FIG. 11 illustrates a rendering process in a rendering section.

While the image after the thinning process is input to the rendering section 221, the controller 3 determines the display position of each frame in the i×j pixels of the image display section 4 on the basis of the value of the scrolling velocity that has already been input to the controller 3 and on the basis of which frame of the scroll image the image data input to the rendering section 221 is. FIG. 11 illustrates a rendering process in the rendering section 221. The outline of the rendering process in the rendering section 221 will be described below with reference to FIG. 11.

FIG. 11 shows display positions of the continuous frames k, k+1, and k+2 as a scroll image displayed within the pixels i×j disposed in the image display section 4. k shown as the "k-th frame" in FIG. 11 is a positive integer. In the image display section 4, frames on which a rendering process based on the image composed of different sampling points as described above with reference to FIG. 10 is performed on the basis of the same still image in the order of the k-th frame, the (k+1)th frame, and the (k+2)th frame . . . are continuously displayed in accordance with a predetermined frame rate at, for example, time t1, t2, and t3, and scrolling display of the still image is performed. As a result of the still image having different sampling points being scroll-displayed at the scrolling velocities Vx and Vy, a super-resolution effect is brought about, and the image is viewed as a high-resolution image.

In the rendering section 221, a rendering process is performed on the input image data in accordance with the display position corresponding to each frame, which is determined by the controller 3. As shown in FIG. 11, with respect to the pixels outside the p×q pixels of the scroll image in the i×j pixels displayed on the image display section 4, it is preferable that control with which pixels do not emit light in the image display section 4 or setting of outputting a uniform background color be performed.

FIG. 11 shows an example in which a scroll image having p×q pixels is moved at the movement velocities of Vx and Vy (pixels/frame), which are user setting parameters in the X-axis direction and in the Y-axis direction, respectively, and a rendering process is performed. The position of the scroll image in each frame is controlled by the controller 3. As shown in FIG. 11, for the (k+1)th frame, the image is moved by Vx in the X direction from the display position of the k-th frame and is moved by Vy in the Y direction, and rendering is performed. For the (k+2)th frame, the image is moved by Vx in the X direction from the display position of the (k+1)th frame and is moved by Vy in the Y direction, and rendering is performed.

With respect to the frame in which p×q pixels of the scroll image are not contained within the i×j pixels of the image display section 4, some of the p×q pixels of the scroll image are lost from the display image. However, since there is no influence on the super-resolution effect in the displayed portion, even if a rendering process is performed with a portion of the scroll image being lost, there is no particular problem. As a result of the rendering process, each frame of the scroll image having i×j pixels, shown in FIG. 11, is generated.

As described above, the image on which a rendering process is performed is image data composed of different sampling points as described above with reference to FIG. 10 on the basis of the same still image in the order of the k-th frame, the (k+1)th frame, and the (k+2)th frame . . . . As a result of these frames being scroll-displayed at the specified movement velocity in accordance with the predetermined frame rate at, for example, time t1, t2, and t3, a super-resolution effect is brought about, and the image is viewed as a high-resolution image.

Figure 12:
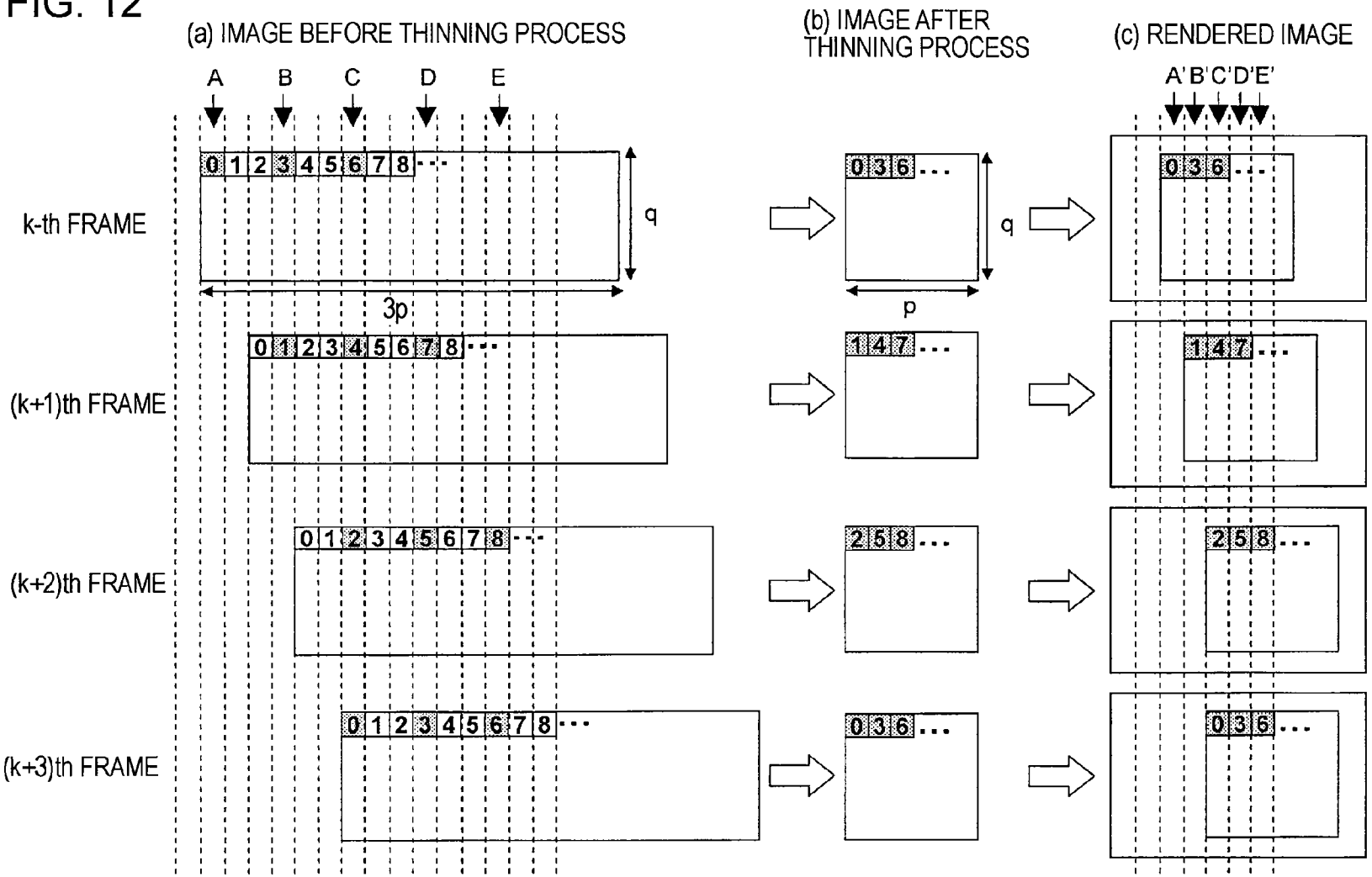
FIG. 12 illustrates a spatial thinning process to be performed by the spatial thinning processor and a rendering process in the rendering section.

Referring to FIG. 12, image data that is scroll-displayed will be described below. As described above, the position of the image data after the thinning process, which is displayed on the image display section 4, within the i×j pixels disposed in the image display section 4, is determined by the controller 3.

FIG. 12 is a view such that a view showing the position relationship of a rendered image after the thinning process, that is, a rendered image generated as the original image of the image output to the image display section 4, is added, as part (c) of FIG. 12, to FIG. 10.

The determination of the position of the image after the thinning process in a rendering process will be described below with reference to a specific example. A description will be given of the example as described above with reference to FIG. 10, that is, an example of a display image generated by a rendering process after the thinning process when the amount of spatial thinning is set as Dx=3 for only the X direction.

For the thinning process on each frame image described with reference to FIG. 10, only the scroll movement in the X direction is considered. The scrolling velocities Vx and Vy specified by the user are:

Vx=⅔ (pixels/frame), and

Vy=0 (pixels/frame).

The amount of spatial thinning Dx in the X direction is Dx=3. The movement velocities Vxo and the Vyo of the image before the thinning process for this case are:

Vxo=VxDx=2 (pixels/frame), and

Vyo=0.

Similarly to parts (a) and (b) of FIG. 10, part (a) of FIG. 12 shows images before the thinning process of the k-th to (k+3) th frames, and part (b) of FIG. 12 shows images after the thinning process of the k-th to (k+3)th frames. In the images before the thinning process of the k-th to (k+3)th frames in part (a) of FIG. 12, specific pixels are extracted as representative pixels (sampling pixels). The image after the thinning process of the k-th to (k+3)th frames are generated by only the sampling pixels and are output.

Part (c) of FIG. 12 shows images that are generated in such a manner that the sampling pixels extracted as a result of performing a spatial thinning process on the basis of the above-described setting of conditions are rendered. The rendered images shown in part (c) of FIG. 12 correspond to the original image of the image displayed on the image display section 4.

In this example of processing, the scrolling velocity Vx in the X direction is set as Vx=⅔ (pixels/frame), and an image that is moved by ⅔ pixels between frames is output. In the display device, movement in units of one pixel is possible. When the setting of Vx=⅔ (pixels/frame) is performed, display control is performed such that the image is moved by 2 pixels each time it is moved by three frames. The rendered image shown in part (c) of FIG. 12 is moved as follows:

is moved by one pixel in the X direction from the k-th frame to the (k+1)th frame, is moved by one pixel in the X direction from the (k+1)th frame to the (k+2)th frame, and is moved by zero pixels in the X direction from the (k+2)th frame to the (k+3)th frame. As a result, movement of two pixels is realized in the k-th to (k+3)th frames, and scrolling of Vx=⅔ (pixels/frame) is performed.

Referring to FIG. 12, a description will be given of the relationship between the sampling pixel position in the image before the thinning process, shown in part (a) of FIG. 12, and the pixel position in the rendered image of part (c) of FIG. 12, which is generated on the basis of the image after the thinning process, shown in part (b) of FIG. 12.

As described above, in the spatial thinning process, as shown in part (a) of FIG. 12, the "image before the thinning process" is assumed to move at the movement velocity Vxo (=2 pixels/frame), and as shown in part (a) of FIG. 12, sampling is performed every three other pixels in the order of position A, B, C, D, and E.

For example, as shown in part (a) of FIG. 12, the pixel at the leftmost among the sampling pixels of the image before the thinning process of the k-th frame is the 0th pixel at the position A. The 0th sampling pixel at the position A of the "image before the thinning process", shown in part (a) of FIG. 12, is drawn at a position A' corresponding to the position A by a rendering process, as shown in the rendered image of part (c) of FIG. 12. At this time, the third sampling pixel at the position B and the sixth sampling pixel at the position C are drawn at the position B' and C' by a rendering process, respectively.

In the next (k+1)th frame, as shown in part (a) of FIG. 12, the sampling pixel does not exist at the position A, and the leftmost pixel among the sampling pixels before the thinning process of the (k+1)th frame is the first pixel present at the position B. The first sampling pixel at the position B shown in part (a) of FIG. 12 of the "image before the thinning process" is drawn at a position B' corresponding to the position B by a rendering process, as shown in the rendered image in part (c) of FIG. 12.

Similarly, the fourth sampling pixel at the position C and the seventh sampling pixel at the position D are drawn at positions C' and D' by a rendering process, respectively, as shown in the rendered image in part (c) of FIG. 12. As a result, in the (k+1)th frame, the position when the "image after the thinning process" is rendered is moved by one pixel from the k-th frame.

In the next (k+2)th frame, as shown in part (a) of FIG. 12, the leftmost sampling pixel is the second pixel at the position C. The second sampling pixel at the position C shown in part (a) of FIG. 12 of the "image before the thinning process" is drawn at the position C' corresponding to the position C by a rendering process, as shown in the rendered image in part (c) of FIG. 12.

Similarly, the fifth sampling pixel at the position D and the eighth sampling pixel at the position E are drawn at positions D' and E' by a rendering process, respectively, as shown in the rendered image in part (c) of FIG. 12. As a result, in the (k+2)th frame, the position when the "image after the thinning process" is rendered is moved by one pixel from the (k+1)th frame.

In the next (k+3)th frame, as shown in part (a) of FIG. 12, the leftmost sampling pixel is the 0th pixels at the position C. The 0th sampling pixel at the position C shown in part (a) of FIG. 12 of the "image before the thinning process" is drawn at the position C' corresponding to the position C by a rendering process, as shown in the rendered image in part (c) of FIG. 12.

Similarly, the third sampling pixel at the position D and the sixth sampling pixel at the position E are drawn at the positions D' and E' by a rendering process, respectively, as shown in the rendered image in part (c) of FIG. 12. As a result, in the (k+3)th frame, the position when the "image after the thinning process" is rendered is moved by 0 pixels from the (k+2)th frame, that is, is set at the same position.

As described above with reference to FIG. 12, the position at which the "image after the thinning process" is rendered is moved in units of pixels in response to the movement of the positions at which pixels are sampled from the "image before the thinning process". The position of the image to be rendered by the rendering section 221 is determined by the controller 3 on the basis of only the value of the scrolling velocity input to the controller 3.

In other words, the output of the spatial thinning processor 213 is only the "image after the thinning process" in FIG. 12. The positions at which pixels are sampled by assuming that the "image before the thinning process" is moving at the movement velocity Vxo, that is, the position data of A, B, C, D, and E shown in part (a) of FIG. 12, is not output.

For this reason, unlike that described with reference to FIG. 12, the rendering position of the "image after the thinning process" cannot be determined in response to the positions at which pixels are sampled from the "image before the thinning process". However, for the determination of the rendering position, the same results as these of the above-described determination method can be obtained even if the data of the sampling positions of pixels in the "image before the thinning process" are unknown. The method will be described below.

The position in the X direction, at which the "image after the thinning process" in the k-th frame shown in part (b) of FIG. 12 is rendered, is represented as a coordinate x(k). x(k) is a positive integer.

Hereinafter, it is assumed that the coordinate value at the upper left corner of the image indicates the position of the image.

The position in the X direction at which the "image after the thinning process" in the initial frame (frame 0) is rendered is represented as a coordinate x(0). x(0) is set as a positive integer.

At this time, x(k) becomes:

$$x(k)=x(0)+\text{ceiling}(Vxk)$$

where the ceiling(Vxk) is such that all digits to the right of the decimal point of the value of [Vx×k] are rounded up.

In the example described with reference to FIG. 12, for example, when the k-th frame is assumed to be an initial frame (k=0), x(1) to x(3) in the (k+1)th to (k+3)th frames (1 to 3 frames) become:

for the (k+1)th frame, x(1)=x(0)+ceiling((⅔)1)=x(0)+1, for the (k+2)th frame, x(2)=x(0)+ceiling((⅔)2)=x(0)+2, and for the (k+3)th frame, x(3)=x(0)+ceiling((⅔)3)=x(0)+2.

As shown in part (c) of FIG. 12, the (k+1)th frame is rendered at a position that is moved by one pixel from the k-th frame, the (k+2)th frame is rendered at a position that is moved by two pixels from the k-th frame, and the (k+3)th frame is rendered at a position that is moved by three pixels from the k-th frame. As a result, rendering is performed at the position shown in part (c) of FIG. 12, and display corresponding to the scrolling velocity of Vx=⅔ (pixels/frame) is performed.

As a result of this processing, the position in the X direction at which the "image after the thinning process" is rendered can be determined by the controller 3 even if the data of the sampling position of the pixel in the "image before the thinning process" is unknown, on the basis of the scrolling velocity and on the basis of which frame of the scroll image the image is.

The example of the processing described with reference to FIG. 12 is an example in which the case of only the scroll movement in the X direction is considered. Alternatively, for the case of the movement only in the Y direction or for the case of scrolling at a movement velocity that is not 0 in the X direction and in the Y direction, similarly, the position of the scroll image can be determined, and a rendering process can be performed.

In the foregoing, the rendering process in the rendering section 221 has been described. The image signal having i×j pixels, which is generated by such a rendering process, is input to the frame memory 222 and is stored therein. The image signal stored in the frame memory 222 is sequentially output and is input to the image display section 4 in response to a timing requested by the image display section 4.

Up to this point, the processing in the number-of-pixel converter 21 and the display image generator 22 in the image converter 2 shown in FIG. 3 has been described according to the procedure. This processing needs to be repeatedly performed by the number of times corresponding to the number of frames of the image that is finally displayed.

Figure 13:
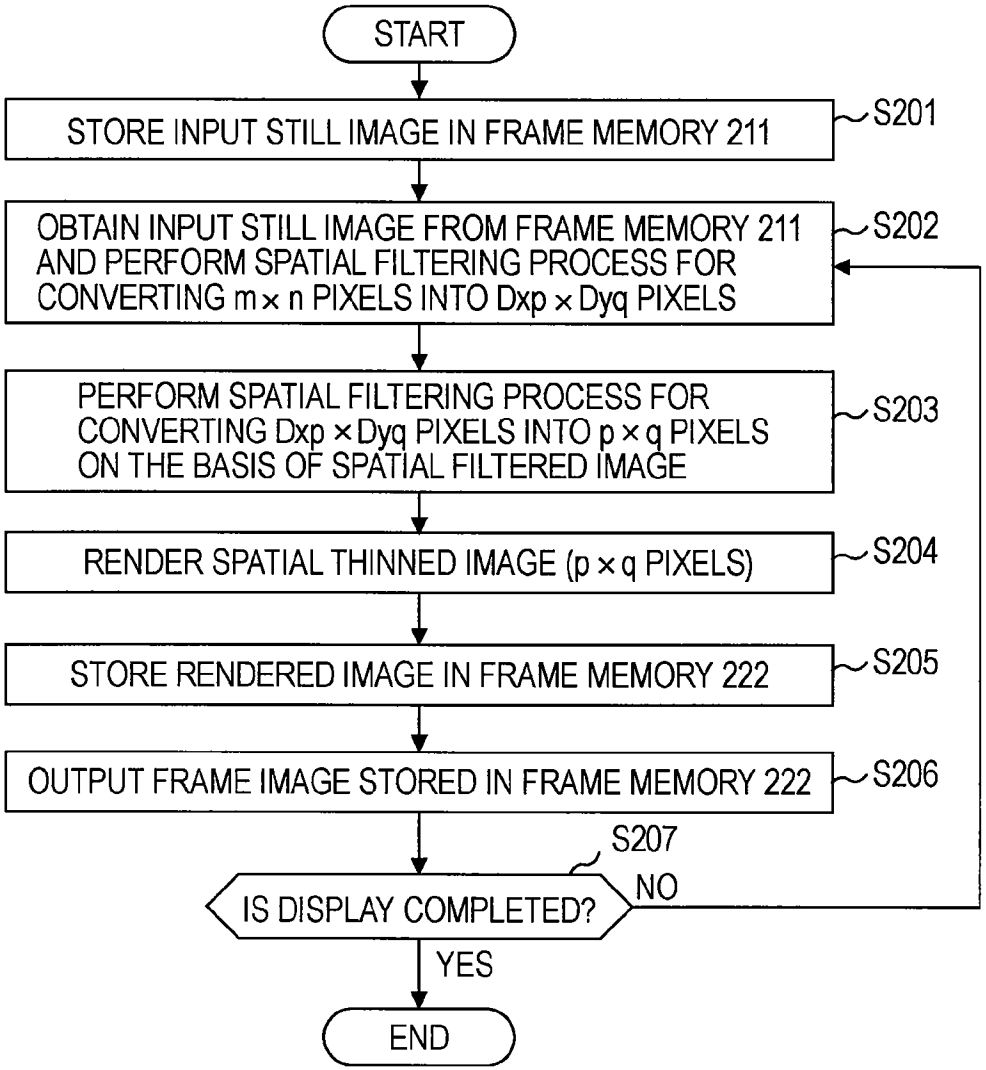
FIG. 13 is a flowchart illustrating a sequence of a spatial filtering process, a spatial thinning process, and a rendering process, which are to be performed by the image converter.

FIG. 13 is a flowchart illustrating the repeated procedure of the spatial filtering process, the spatial thinning process, and the rendering process to be performed by the image converter 2. The still image signal input to the image converter 2 is kept to be stored in the frame memory 211 while the display device is operating or the input image is changed.

In step S201, the still image stored in the frame memory 211 is subjected to a spatial filtering process in the spatial filtering processor 212 in step S202.

This process is a process for converting the input still image (m×n pixels) into an image having Dxp×Dyq pixels.

Next, in step S203, in the spatial thinning processor, a thinning process is performed on each frame image. This process is a process as described above with reference to FIG. 10 and other figures and is a process for converting an image having DxP×Dyq pixels into an image having p×q pixels. This process is performed as a process for extracting sampling pixels.

Next, in step S204, a rendering process based on the image having p×q pixels corresponding to each frame is performed by the rendering section 221. In step S205, the rendered image is recorded in the frame memory 222. In step S206, the frame image recorded in the frame memory 222 is output to the image display section 4.

In step S207, it is determined whether or not the display process has been completed. When it is still being continued, processing of step S202 and subsequent steps is repeatedly performed. As a result of this processing, on the image display section, scroll display of the generated image based on the still image is performed. When it is determined in step S207 that the display process has been completed, the processing is completed.

In the manner described above, the spatial filtering process, the spatial thinning process, and the rendering process are performed as a repeated process for each frame image to be displayed on the image display section. That is, an image signal is received from the frame memory 211, and processing is repeatedly performed by the number of times corresponding to the number of frames of the scroll image.

In the display device in this embodiment, the values of the number of pixels of the scroll image and the scrolling velocity thereof are fixed once they are specified. For this reason, for the spatial filtering process to be performed by the spatial filtering processor 212, exactly the same processing is performed on all the frames. On the other hand, in the spatial thinning processor 213, since the thinning position differs in each frame, different processing is performed for each frame.

Therefore, if the configuration is structured in such a way that a new memory for recording an image signal after a spatial filtering process is set, and the spatial thinning processor 213 obtains an image after the spatial filtering process and performs processing, processing for the input still image can be performed in one process without performing processing of the spatial filtering processor in a duplicated manner.

Figure 14:
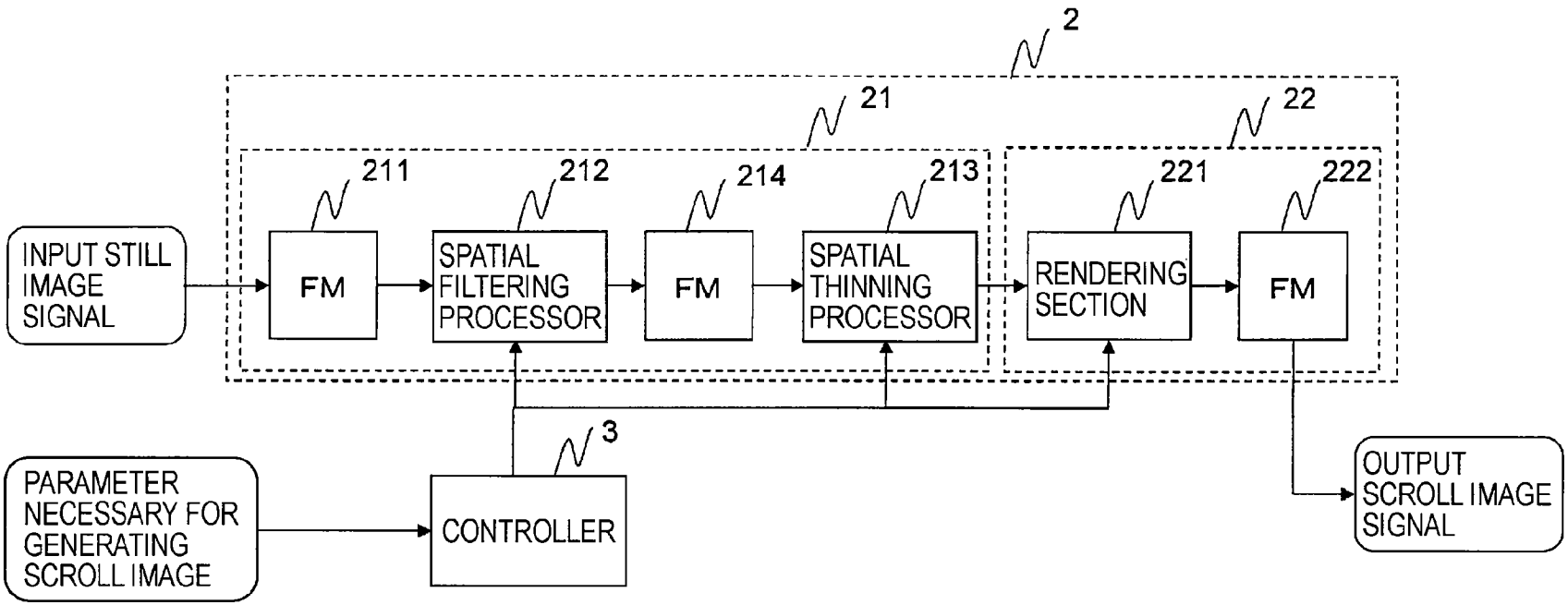
FIG. 14 shows an example of the configuration of an image converter in which a repeated process of the spatial filtering process can be omitted.

An example of the configuration of an image processing apparatus having such a processing configuration is shown in FIG. 14. FIG. 14 shows a configuration in which the processing blocks of the image converter 2 shown in FIG. 3 are changed so that the duplicated processing of the spatial filtering process can be prevented.

The feature of the image processing apparatus shown in FIG. 14 is that a frame memory 214 is provided between the spatial filtering processor 212 and the spatial thinning processor 213 so that an image after a filtering process is performed thereon only once is stored in the frame memory 214.

Figure 15:
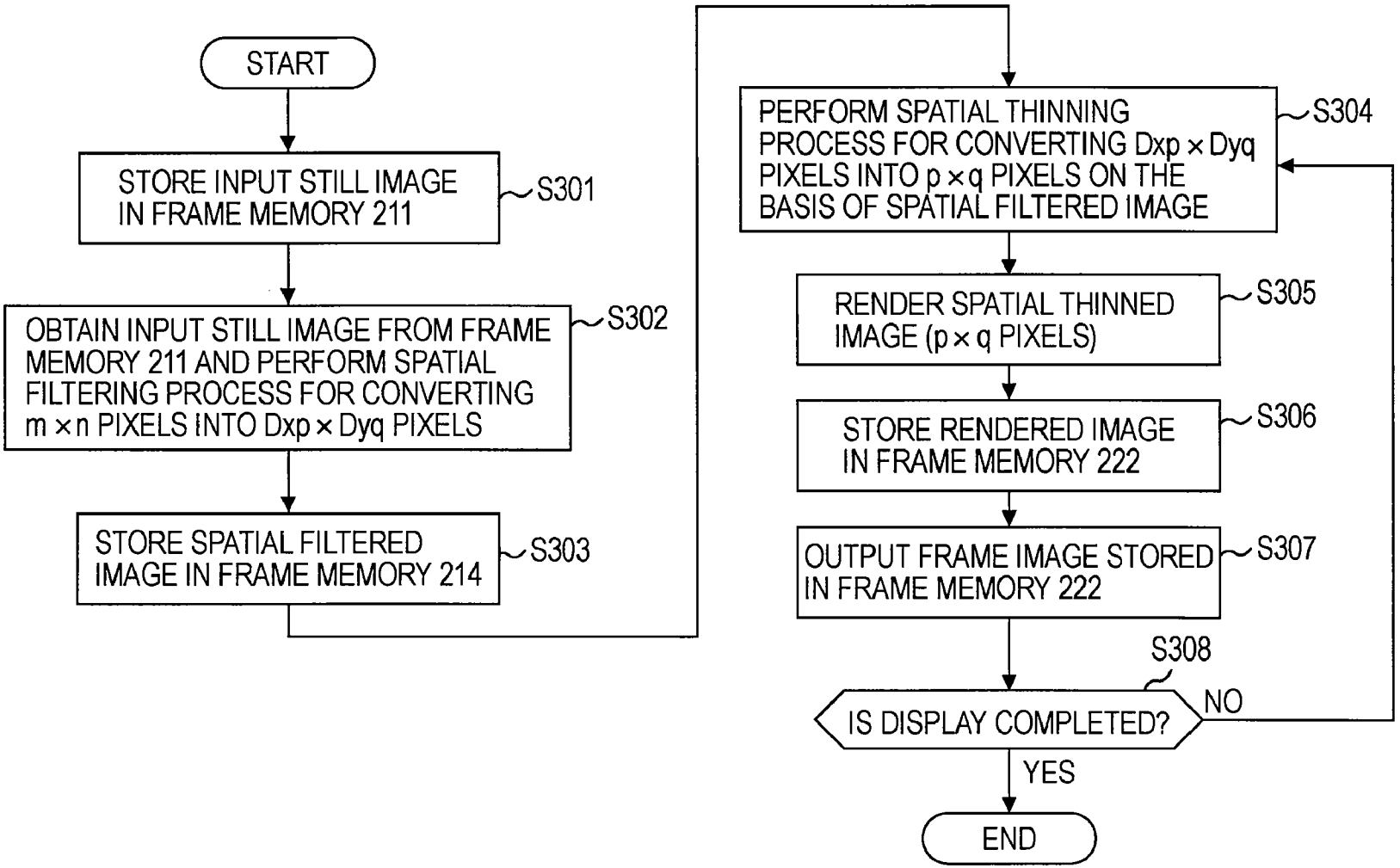
FIG. 15 is a flowchart illustrating a processing sequence of the image converter in which a repeated process of the spatial filtering process can be omitted.

FIG. 15 is a flowchart illustrating the processing sequence in the configuration of the image converter 2 shown in FIG. 14.

In step S301, the still image is stored in the frame memory 211. In step S302, a spatial filtering process in the spatial filtering processor 212 is performed on the still image.

This process is a process for converting an input still image (m×n pixels) into an image having Dxp×Dyq pixels.

Next, in step S303, the image on which the spatial filtering process has been performed is stored in the frame memory 214. In step S304, in the spatial thinning processor, the image on which the spatial filtering process has been performed, which is stored in the frame memory 214, is obtained, and a thinning process is performed for each frame image. This process is a process as described above with reference to FIG. 10 and other figures, and is a process for converting an image having DxP×Dyq pixels into an image having p×q pixels. This process is performed as a process for extracting sampling pixels.

Next, in step S305, a rendering process based on the image having p×q pixels corresponding to each frame is performed by the rendering section 221. In step S306, the rendered image is recorded in the frame memory 222. In step S307, the frame image recorded in the frame memory 222 is output to the image display section 4.

In step S308, it is determined whether or not the display process has been completed. When it is still being continued, processing of step S304 and subsequent steps is repeatedly performed. As a result of this processing, on the image display section, scroll display of the image generated on the basis of the still image is performed. When it is determined in step S308 that the display process has been completed, the processing is completed.

As described above, in this example of processing, the spatial filtering process needs only to be performed once, and the spatial thinning process and the rendering process need only to be performed as a repeated process for each frame image to be displayed on the image display section. The image signal output from the display image generator 22 is sequentially input to the image display section 4 in each frame.

The image display section 4 displays this processed image at a predetermined frame rate and, preferably, at a high frame rate. As a result, the super-resolution effect enables an observer to view an image having a spatial resolution exceeding the number of pixels p×q pixels of the scroll image in the image display section 4. At this time, the space resolution perceived by the observer corresponds to Dxp×Dyq pixels, which is a product of the amount of thinning in the above-described spatial thinning process and the number of pixels of the light-emission area. However, the spatial resolution corresponding to the m×n pixels is assumed to be an upper limit.

Next, a description will be given of a second embodiment of the image processing apparatus of the present invention. In the first embodiment of the image processing apparatus of the present invention, the number of pixels of the scroll image and the data of the scrolling velocity thereof serving as parameters necessary for generating a scroll image are input externally.

Figure 16:
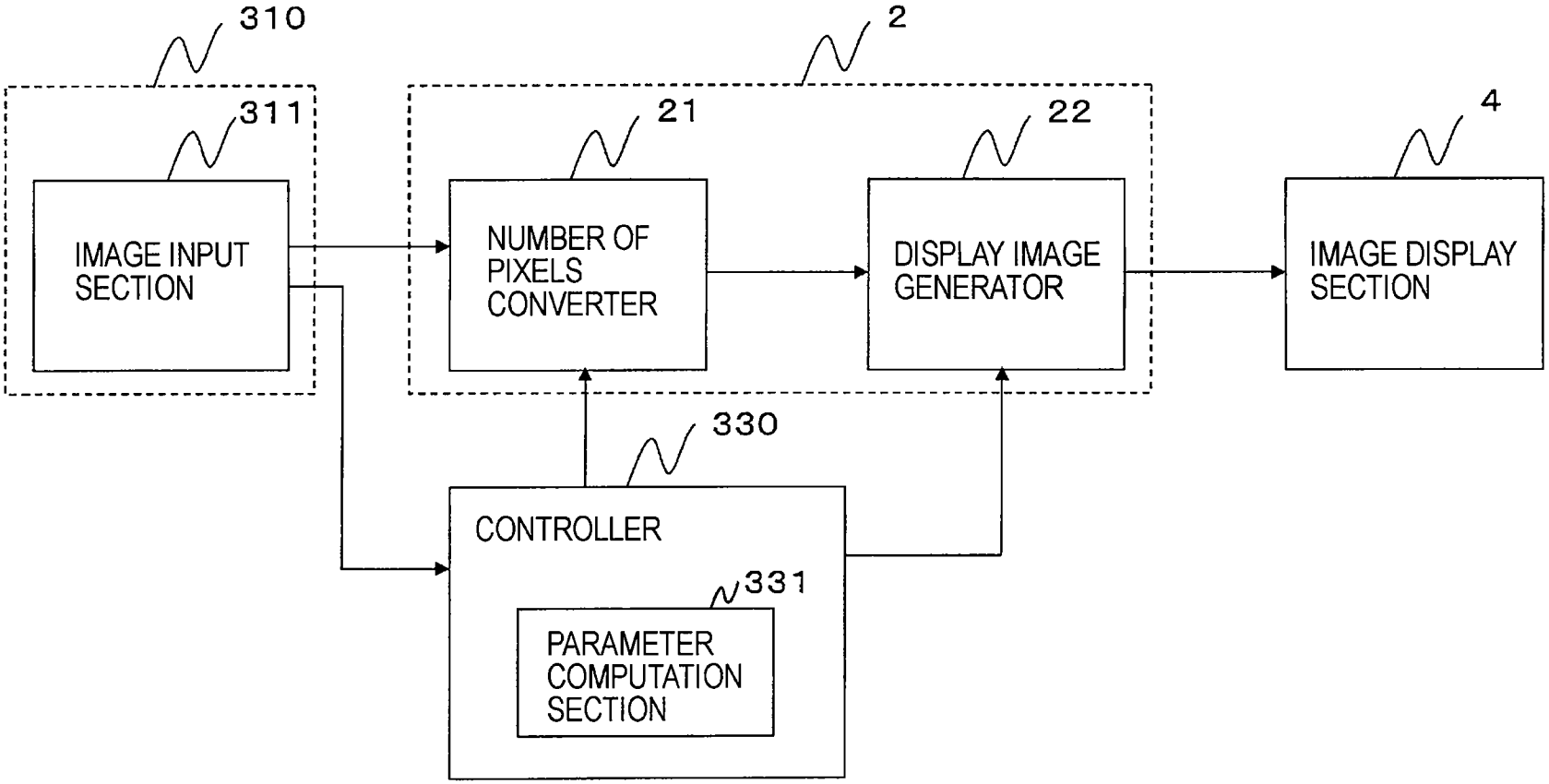
FIG. 16 illustrates an image processing apparatus according to a second embodiment of the present invention.

In comparison, the image processing apparatus of the second embodiment has a configuration in which values of parameters for generating a scroll image, which satisfy conditions under which a super-resolution effect is obtained and a spatial resolution higher than or equal to the number of display pixels can be represented, are automatically computed inside the display device. FIG. 16 shows the configuration of the image processing apparatus according to the second embodiment of the present invention.

The difference from the configuration of the image processing apparatus in the first embodiment (FIG. 1) is that a parameter input section is not provided in an interface section 310, and only an image input section 311 is provided. The remaining construction in FIG. 16 is substantially the same as that of the apparatus shown in FIG. 1. Processing in a controller 330 is different.

In this embodiment, the values of the number of pixels of a scroll image and the scrolling velocity thereof are not input externally in the interface section, and are computed in the controller 330. A parameter computation section 331 is provided in the controller 330. By using as input the value of the number of pixels of the still image signal, which is read by the image input section 311, the values of the number of pixels of the scroll image and the scrolling velocity thereof, which satisfy conditions under which the super-resolution effect is obtained, are computed internally, and these values are used for parameters for generating a scroll image. This configuration enables the control of the spatial filtering process and the spatial thinning process in the image converter 2.

An example in which the values of the number of pixels of the scroll image and the scrolling velocity thereof are determined in the parameter computation section 331 of the controller 330 is described below.

For example, it is assumed that an input still image has a number of pixels m×n and the image display section 4 is formed of a display device having i×j pixels. m, n, i, and j are positive integers, and the conditions of m>i and n>j are satisfied.

Initially, the parameter computation section 331 of the controller 330 receives the values of m and n from the interface section 310 and appropriately determines the value of the number of pixels p×q of the light-emission area of the scroll image output after image conversion. p and q are positive integers. In this determination method, although it does not particularly matter, it is generally considered that the values of p and q that satisfy the conditions of m>i>p and n>j>q and the conditions of m/n=p/q are determined so that the length and breadth ratio of the image is made uniform between input and output to and from the image conversion section.

The parameter computation section 331 of the controller 330 determines p and q and thereafter determines the amounts of thinning Dx and Dy in the spatial thinning processor of the number-of-pixel converter 2. By setting a maximum amount of thinning into Dx and Dy under the conditions of the amount of thinning that satisfy the conditions under which the super-resolution effect is obtained, the spatial resolution that can be perceived by the observer is most improved (for example, when the correspondence between the movement velocity and the amount of thinning, shown in FIG. 7, holds, Dx=4 and Dy=4). Furthermore, on the basis of the relationship between the movement velocity and the amount of thinning, shown in FIG. 7, of the first embodiment, the scrolling velocity is determined by using the amounts of thinning Dx and Dy that have already been determined.

As described above, the parameter computation section 331 of the controller 330 determines the values of the number of pixels of the scroll image and the scrolling velocity thereof, which are parameters that are externally input in the first embodiment. On the basis of these determination values, the number-of-pixel converter 2 performs a spatial filtering process and a spatial thinning process and generates image data that brings about a super-resolution effect. These processes are identical to those of the first embodiment.

In the foregoing, a method for automatically computing the values of parameters for generating a scroll image inside a display device is described. The above-described method is only an example, and the second embodiment of the present invention does not deny the existence of other parameter determination methods. In the second embodiment of the present invention, a case in which the values of the number of pixels of the scroll image and the scrolling velocity thereof are entirely determined automatically is described. A case in which some of parameters of a scroll image, which can represent a spatial resolution higher than the number of pixels of the display by means of a super-resolution effect, are determined is within the scope of the second embodiment. Specific examples thereof include a method in which only one of the number of pixels of the scroll image and the scrolling velocity thereof is input by the user (input on the GUI is considered), and the value of the other parameter that is not determined by the user is automatically determined in a display device so that a spatial resolution exceeding the number of display pixels can be represented by a super-resolution effect. In these cases, regarding the configuration of the display device, a parameter input section can be provided inside an interface section similarly to FIG. 1 shown in the first embodiment.

The series of processes described in the specification can be performed by hardware, software, or the combined configuration of them. When a process is to be performed by software, a program in which a processing sequence is recorded can be installed into a memory incorporated into dedicated hardware inside a computer, whereby the program is executed, or a program can be installed into a general-purpose computer capable of performing various processing, whereby the program is executed.

For example, a program can be recorded in advance in a hard disk and a ROM (Read Only Memory) as a recording medium. Alternatively, a program can be temporarily or permanently stored (recorded) in a removable recording medium, such as a flexible disk, a CD-ROM (Compact Disc Read-Only Memory), an MO (Magneto optical) disc, a DVD (Digital Versatile Disc), a magnetic disk, or a semiconductor memory. Such a removable recording medium can be provided as so-called packaged software.

In addition to being installed into a computer from the removable recording medium such as that described above, programs may be transferred in a wireless manner from a download site or may be transferred by wire to a computer via a network, such as a LAN (Local Area Network) or the Internet, and it is possible for the computer to receive the programs which are transferred in such a manner and to install the programs into the hard disk contained therein.

Various processes described in the specification may be executed chronologically according to the written orders. However, they do not have to be executed chronologically, and they may be executed concurrently or individually according to the processing performance of the device that performs a process or according to the necessity. The system in this specification is a logical assembly of a plurality of devices, and it is not essential that the devices be disposed in the same housing.

It should be understood by those skilled in the art that various modifications, combinations, sub-combinations and alterations may occur depending on design requirements and other factors insofar as they are within the scope of the appended claims or the equivalents thereof.

What is claimed is:

1. An image processing apparatus comprising:

an image input section configured to input still image data, the still image to be input to the image input section is an input image having a number of pixels m×n;

a number-of-pixel converter configured to perform number-of-pixel conversion on the still image data;

a display image generator configured to generate a scroll display image as output image data to be output to an image display section on the basis of the image data whose number of pixels has been converted, the image data being generated by the number-of-pixel converter, the scroll display image to be output to the image display section is an output image having a number of pixels p×q; and a controller configured to control number-of-pixel conversion and display image generation, wherein the number-of-pixel converter includes a spatial filtering processor and a spatial thinning processor, the spatial thinning processor being configured for performing, on each of a plurality of frame images forming the scroll display image, a spatial thinning process in accordance with the amount of spatial thinning with which a super-resolution effect is obtained, the amount of spatial thinning being determined on the basis of a scrolling velocity, and wherein the display image generator generates the scroll display image on the basis of each frame image on which the spatial thinning process has been performed, when the amount of spatial thinning with which the super-resolution effect is obtained is set as an amount of thinning Dx in the X direction and as an amount of thinning Dy in the Y direction, the spatial filtering processor performs a process for converting the input image corresponding to a respective one of the frame images of the scroll display image and having the number of pixels m×n into an intermediate frame image having a number of pixels Dxp×Dyq, and on the basis of the intermediate frame image having the number of pixels Dxp×Dyq, which is generated by the spatial filtering processor, the spatial thinning processor performs a spatial thinning process in which the amount of thinning in the X direction is Dx and the amount of thinning in the Y direction is Dy, samples pixels Dxp in the X direction based on Dx, samples pixels Dyq in the Y direction based on Dy, and generates an output frame image having a number of pixels p×q after sampling in the X direction and the Y direction.

2. The image processing apparatus according to claim 1, wherein the controller performs a process for determining the amount of thinning that satisfies conditions under which the super-resolution effect is obtained on the basis of the scrolling velocity of a scroll display image to be displayed on the image display section, and the spatial thinning processor performs a spatial thinning process in accordance with the amount of spatial thinning determined by the controller.

3. The image processing apparatus according to claim 1, wherein the controller performs a process for determining the amount of spatial thinning on the basis of a table in which the scrolling velocity of a scroll display image to be displayed on the image display section and the amount of spatial thinning that satisfies conditions under which the super-resolution effect is obtained correspond to each other, and the spatial thinning processor performs a spatial thinning process in accordance with the amount of spatial thinning determined by the controller.

4. The image processing apparatus according to claim 1, wherein the controller performs a process for sequentially verifying, on the basis of a predetermined maximum value, whether or not the scrolling velocity of a scroll display image to be displayed on the image display section falls within a velocity range corresponding to the amount of spatial thinning that satisfies conditions under which the super-resolution effect is obtained, and for determining a largest value of spatial thinning as an amount of thinning in the spatial thinning processor, and the spatial thinning processor performs a spatial thinning process in accordance with the amount of spatial thinning determined by the controller.

5. The image processing apparatus according to claim 1, further comprising a memory for storing the intermediate frame images processed by the spatial filtering processor, wherein, on the basis of the intermediate frame image having a number of pixels Dxp×Dyq, which is obtained from the memory, the spatial thinning processor performs the spatial thinning process for each frame and generates a corresponding output frame image having a number of pixels p×q.

6. The image processing apparatus according to claim 1, further comprising a parameter input section configured to input a parameter of the scrolling velocity, wherein the controller determines the amount of thinning to be performed in the spatial thinning processor on the basis of the scrolling velocity input from the parameter input section.

7. The image processing apparatus according to claim 1, wherein the controller comprises a parameter computation section configured to determine a parameter of the scrolling velocity, and the parameter computation section performs a process for inputting a number of pixels of a still image to be input to the image input section, for computing the values of the number of pixels of the scroll display image and the scrolling velocity of the scroll display image, which satisfy conditions under which the super-resolution effect is obtained, and for determining the amount of thinning to be performed in the spatial thinning processor in accordance with the computed number of pixels and the computed scrolling velocity.

8. The image processing apparatus according to any of claims 1-4 or 5-7, wherein, on the basis of the output frame image on which a spatial thinning process has been performed for each frame, the display image generator is configured to perform a rendering process in units of frames, in which frame movement based on the scrolling velocity is considered.

9. The image processing apparatus according to any of claims 1-4 or 5-7, further comprising an image display section configured to display a scroll display image generated by the display image generator.

10. An image processing method comprising the steps of:

inputting still image data, the still image to be input to the image input section is an input image having a number of pixels m×n;

determining an image processing parameter;

performing number-of-pixel conversion on the still image data on the basis of the parameter, the step of performing number-of-pixel conversion comprises the steps of performing a spatial filtering process and performing a spatial thinning process; and generating a scroll display image as output image data to be output to an image display section on the basis of the image data whose number of pixels has been converted, the image data being generated in the number-of-pixel conversion, the scroll display image to be output to the image display section is an output image having a number of pixels p×q, wherein the number-of-pixel conversion includes the step of performing, on each of a plurality of frame images forming the scroll display image, the spatial thinning process in accordance with the amount of spatial thinning with which a super-resolution effect is obtained, the amount of spatial thinning being determined on the basis of a scrolling velocity, and wherein, in the display image generation, a process for generating a scroll display image on the basis of a frame image on which the spatial thinning process has been performed for each frame is performed, when the amount of spatial thinning with which the super-resolution effect is obtained is set as an amount of thinning Dx in the X direction and as an amount of thinning Dy in the Y direction, the spatial filtering process includes converting the input image corresponding to a respective one of the frame images of the scroll display image and having a number of pixels m×n into an intermediate frame image having a number of pixels Dxp×Dyq, and on the basis of the intermediate frame image having the number of pixels Dxp×Dyq, which is generated in the spatial filtering, the spatial thinning process includes sampling pixels Dxp in the X direction based on the amount of thinning in the X direction being Dx, sampling pixels Dyq in the Y direction based the amount of thinning in the Y direction being Dy, and generating an output frame image having a number of pixels p×q after sampling in the X direction and the Y direction.

11. The image processing method according to claim 10, wherein, in the parameter determination, a process for determining the amount of spatial thinning that satisfies conditions under which the super-resolution effect is obtained on the basis of the scrolling velocity of the scroll display image to be displayed on the image display section is performed, and in the spatial thinning, a spatial thinning process in accordance with the amount of spatial thinning determined in the parameter determination is performed.

12. The image processing method according to claim 10, wherein, in the parameter determination, a process for determining the amount of spatial thinning on the basis of a table in which the scrolling velocity of the scroll display image to be displayed on the image display section and the amount of spatial thinning that satisfies conditions under which the super-resolution effect is obtained correspond to each other is performed, and in the spatial thinning, a spatial thinning process in accordance with the amount of spatial thinning determined in the parameter determination is performed.

13. The image processing method according to claim 10, wherein, in the parameter determination, a process is performed for sequentially verifying, on the basis of a predetermined maximum value, whether or not the scrolling velocity of the scroll display image to be displayed on the image display section falls within a velocity range corresponding to the amount of spatial thinning that satisfies conditions under which the super-resolution effect is obtained, and for determining a largest value of spatial thinning as an amount of thinning in the spatial thinning, and in the spatial thinning, a spatial thinning process in accordance with the amount of spatial thinning determined in the parameter determination is performed.

14. The image processing method according to claim 10, further comprising the step of storing, in a memory, the intermediate frame processed in the spatial filtering, wherein, on the basis of the intermediate frame image having the number of pixels Dxp×Dyq, which is obtained from the memory, in the spatial thinning, a spatial thinning process is performed for each frame, and a corresponding output frame image having a number of pixels p×q is generated.

15. The image processing method according to claim 10, further comprising the step of inputting a parameter of the scrolling velocity, wherein, in the parameter determination, a process for determining the amount of thinning to be used in the spatial thinning on the basis of the scrolling velocity input in the parameter input is performed.

16. The image processing method according to claim 10, wherein, in the parameter determination, a process is performed for inputting the number of pixels of the still image input in the image input, for computing the values of the number of pixels of the scroll display image and the scrolling velocity of the scroll display image, which satisfy conditions under which the super-resolution effect is obtained, and for determining the amount of thinning to be performed in the spatial thinning on the basis of the computed number of pixels and the computed scrolling velocity.

17. The image processing method according to any of claims 1-13 or 14-16, wherein, on the basis of the output frame image on which a spatial thinning process has been performed for each frame, the display image generation comprises the step of performing a rendering process in units of frames, in which frame movement based on the scrolling velocity is considered.

18. The image processing method according to any of claims 1-13 or 15-16, further comprising the step of displaying a scroll display image generated in the display image generation.

19. A computer-readable recording medium having a computer program for enabling an image processing apparatus to perform a process for generating the scroll display image based on a still image, the computer program comprising the steps of:

inputting still image data, the still image to be input to the image input section is an input image having a number of pixels m×n;

determining an image processing parameter;

performing number-of-pixel conversion on the still image data on the basis of the parameter, the step of performing number-of-pixel conversion comprises the steps of performing a spatial filtering process and performing a spatial thinning process; and generating a scroll display image as output image data to be output to an image display section on the basis of the image data whose number of pixels has been converted, the image data being generated in the number-of-pixel conversion, the scroll display image to be output to the image display section is an output image having a number of pixels p×q, wherein the number-of-pixel conversion includes the step of performing, on each of a plurality of frame images forming the scroll display image, a the spatial thinning process in accordance with the amount of spatial thinning with which a super-resolution effect is obtained, the amount of spatial thinning being determined on the basis of a scrolling velocity, and wherein, in the display image generation, a process for generating a scroll display image on the basis of a frame image on which the spatial thinning process has been performed for each frame is performed, when the amount of spatial thinning with which the super-resolution effect is obtained is set as an amount of thinning Dx in the X direction and as an amount of thinning Dy in the Y direction, the spatial filtering process includes converting the input image corresponding to a respective one of the frame images of the scroll display image and having a number of pixels m×n into an intermediate frame image having a number of pixels Dxp×Dyq, and on the basis of the intermediate frame image having the number of pixels Dxp×Dyq, which is generated in the spatial filtering, the spatial thinning process includes sampling pixels Dxp in the X direction based on the amount of thinning in the X direction being Dx, sampling pixels Dyq in the Y direction based the amount of thinning in the Y direction being Dy, and generating an output frame image having a number of pixels p×q after sampling in the X direction and the Y direction.

* * * * *